US008721431B2

(12) United States Patent
Kisenwether et al.

(10) Patent No.: US 8,721,431 B2
(45) Date of Patent: May 13, 2014

(54) SYSTEMS, METHODS, AND DEVICES FOR PROVIDING INSTANCES OF A SECONDARY GAME

(75) Inventors: Joseph Kisenwether, Sparks, NV (US); Jeff Mincey, Reno, NV (US); Loren Nelson, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1218 days.

(21) Appl. No.: 12/112,740

(22) Filed: Apr. 30, 2008

(65) Prior Publication Data

US 2009/0275393 A1 Nov. 5, 2009

(51) Int. Cl.
*G07F 17/32* (2006.01)

(52) U.S. Cl.
USPC ..... 463/25; 463/29

(58) Field of Classification Search
USPC ..... 463/16–20, 25, 29
See application file for complete search history.

(56) References Cited

U.S. PATENT DOCUMENTS

| | | | | |
|---|---|---|---|---|
| 3,966,047 | A | 6/1976 | Steiner | 209/75 |
| 4,244,582 | A | 1/1981 | Raees et al. | 273/293 |
| 4,283,708 | A | 8/1981 | Lee | 340/146.3 Z |
| 4,339,798 | A | 7/1982 | Hedges et al. | |
| 4,373,726 | A | 2/1983 | Churchill et al. | |
| 4,448,419 | A | 5/1984 | Telnaes | 273/143 R |
| 4,470,496 | A | 9/1984 | Steiner | 194/4 C |
| 4,475,564 | A | 10/1984 | Koester et al. | 133/8 R |
| 4,482,058 | A | 11/1984 | Steiner | 209/534 |
| 4,503,963 | A | 3/1985 | Steiner | 194/4 C |
| 4,518,001 | A | 5/1985 | Branham | 133/5 R |
| 4,574,824 | A | 3/1986 | Paulsen et al. | 133/4 R |
| 4,588,292 | A | 5/1986 | Collins | 356/71 |
| 4,592,377 | A | 6/1986 | Paulsen et al. | 133/5 R |

(Continued)

FOREIGN PATENT DOCUMENTS

| | | |
|---|---|---|
| CA | 1206173 | 6/1986 |
| DE | 19940954 A1 | 3/2001 |

(Continued)

OTHER PUBLICATIONS

Bally Technologies, Inc., iVIEW, http://ballytech.com/systems/product.cfm?id=9, download date Nov. 6, 2007, 2 pages.

(Continued)

*Primary Examiner* — Arthur O Hall
*Assistant Examiner* — Jasson Yoo
(74) *Attorney, Agent, or Firm* — Frank Abramonte; Fearon Brown; Marvin Hein

(57) ABSTRACT

A gaming machine is configured to selectively provide instances of a primary game and instances of a secondary game. Instances of the secondary game may be provided based at least on outcomes of primary games. The gaming machine may provide instances of the secondary game based at least on a number of secondary game credits. The number of secondary game credits may be associated with a player of the gaming machine. The number of secondary game credits may be awarded to a player of the gaming machine based at least on an outcome of the primary game and/or an outcome of the secondary game. The gaming machine may provide instances of the secondary game based at least on a number of available secondary game credits. The number of available secondary game credits may be based at least on a number of secondary game credits and/or a number of other credits.

17 Claims, 8 Drawing Sheets

(56) References Cited

U.S. PATENT DOCUMENTS 4,650,057 A 3/1987 Koester ..... 194/346
4,721,307 A 1/1988 Okada ..... 273/143 R
4,725,079 A 2/1988 Koza et al.
4,802,218 A 1/1989 Wright et al. ..... 380/23
4,832,341 A 5/1989 Muller et al.
4,837,728 A 6/1989 Barrie et al. ..... 364/412
4,861,041 A 8/1989 Jones et al. ..... 273/292
4,885,700 A 12/1989 Kondziolka et al. ..... 364/519
4,926,996 A 5/1990 Eglise et al. ..... 194/212
4,948,138 A 8/1990 Pease et al.
4,973,851 A 11/1990 Lee ..... 250/556
4,978,322 A 12/1990 Paulsen ..... 453/57
4,995,615 A 2/1991 Cheng ..... 273/292
5,083,800 A 1/1992 Lockton
5,100,137 A 3/1992 Fulton ..... 273/85 CP
5,167,411 A 12/1992 Isobe ..... 271/273
5,167,413 A 12/1992 Fulton ..... 273/85 CP
5,167,571 A 12/1992 Waller ..... 453/29
5,179,517 A 1/1993 Sarbin et al. ..... 364/410
5,199,710 A 4/1993 Lamle ..... 273/149 R
5,242,041 A 9/1993 Isobe ..... 194/207
5,242,163 A 9/1993 Fulton ..... 273/85 CP
5,248,142 A 9/1993 Breeding ..... 273/138 R
5,251,897 A 10/1993 Fulton ..... 273/85 CP
5,258,837 A 11/1993 Gormley
5,265,874 A 11/1993 Dickinson et al. ..... 273/138 A
5,275,400 A 1/1994 Weingardt et al. ..... 273/85 CP
5,321,241 A 6/1994 Craine
5,324,035 A 6/1994 Morris et al.
5,326,104 A 7/1994 Pease et al.
5,332,219 A 7/1994 Marnell, II et al. ..... 273/138 A
5,344,144 A 9/1994 Canon ..... 273/138 A
5,364,104 A 11/1994 Jones et al. ..... 273/292
5,381,019 A 1/1995 Sato ..... 250/556
5,386,103 A 1/1995 DeBan et al.
5,393,067 A 2/1995 Paulsen et al. ..... 273/292
5,397,125 A 3/1995 Adams ..... 273/138 A
5,398,932 A 3/1995 Eberhardt et al.
5,411,257 A 5/1995 Fulton ..... 273/85 CP
5,417,430 A 5/1995 Breeding ..... 273/292
5,420,406 A 5/1995 Izawa et al. ..... 235/379
5,431,408 A 7/1995 Adams ..... 273/306
5,435,778 A 7/1995 Castle et al. ..... 453/32
5,437,451 A 8/1995 Fulton ..... 273/138 A
5,472,194 A 12/1995 Breeding et al. ..... 273/138 A
5,487,544 A 1/1996 Clapper, Jr. ..... 273/138 A
5,493,613 A 2/1996 Denno et al.
5,494,144 A 2/1996 Izawa ..... 194/203
5,505,449 A 4/1996 Eberhardt et al.
5,505,461 A 4/1996 Bell et al. ..... 273/433
5,507,489 A 4/1996 Reibel et al.
5,531,640 A 7/1996 Inoue ..... 453/17
5,544,892 A 8/1996 Breeding ..... 273/292
5,544,893 A 8/1996 Jones et al. ..... 273/309
5,562,284 A 10/1996 Stevens ..... 273/139
5,570,885 A 11/1996 Ornstein ..... 463/27
5,580,311 A 12/1996 Haste, III
5,605,334 A 2/1997 McCrea, Jr. ..... 273/309
5,605,504 A 2/1997 Huang ..... 463/22
5,605,506 A 2/1997 Hoorn et al.
5,613,680 A 3/1997 Groves et al.
5,613,912 A 3/1997 Slater
5,615,280 A 3/1997 Izawa et al. ..... 382/135
5,636,842 A 6/1997 Cabot et al. ..... 273/292
5,636,843 A 6/1997 Roberts ..... 273/292
5,643,086 A 7/1997 Alcorn et al.
5,645,486 A 7/1997 Nagao et al. ..... 463/27
5,653,635 A 8/1997 Breeding ..... 463/11
5,655,961 A 8/1997 Acres et al.
5,676,231 A 10/1997 Legras et al. ..... 194/206
5,685,774 A 11/1997 Webb ..... 463/13
5,707,287 A 1/1998 McCrea, Jr. ..... 463/27
5,711,525 A 1/1998 Breeding ..... 273/292
5,735,525 A 4/1998 McCrea, Jr. ..... 273/309
5,737,418 A 4/1998 Saffari et al. ..... 380/9
5,741,183 A 4/1998 Acres et al.
5,745,110 A 4/1998 Ertemalp
5,759,102 A 6/1998 Pease et al.
5,766,076 A 6/1998 Pease et al. ..... 463/27
5,769,458 A 6/1998 Carides et al. ..... 283/102
5,770,533 A 6/1998 Franchi ..... 463/42
5,779,545 A 7/1998 Berg et al.
5,788,574 A 8/1998 Ornstein et al. ..... 463/25
5,794,964 A 8/1998 Jones et al. ..... 273/309
5,795,225 A 8/1998 Jones et al. ..... 463/13
5,800,268 A 9/1998 Molnick
5,803,809 A 9/1998 Yoseloff ..... 463/13
5,813,912 A 9/1998 Shultz ..... 463/25
5,816,918 A * 10/1998 Kelly et al. ..... 463/16
5,823,534 A 10/1998 Banyai ..... 273/269
5,823,879 A 10/1998 Goldberg et al.
5,830,067 A 11/1998 Graves et al. ..... 463/40
5,830,068 A 11/1998 Brenner et al.
5,836,435 A 11/1998 Fujita et al. ..... 194/206
5,836,586 A 11/1998 Marks et al. ..... 273/292
5,839,730 A 11/1998 Pike ..... 273/292
5,842,921 A 12/1998 Mindes et al. ..... 463/16
5,850,447 A 12/1998 Peyret
5,851,011 A 12/1998 Lott ..... 273/292
5,851,148 A 12/1998 Brune et al. ..... 463/25
5,851,149 A 12/1998 Xidos et al.
5,855,515 A 1/1999 Pease et al. ..... 463/27
5,867,586 A 2/1999 Liang ..... 382/112
5,885,158 A 3/1999 Torango et al. ..... 463/27
5,890,963 A 4/1999 Yen ..... 463/42
5,902,983 A 5/1999 Crevelt et al. ..... 235/380
5,910,044 A 6/1999 Luciano, Jr. et al. ..... 453/32
5,911,418 A 6/1999 Adams ..... 273/274
5,911,419 A 6/1999 Delaney et al. ..... 273/292
5,911,626 A 6/1999 McCrea, Jr. ..... 463/27
5,919,091 A 7/1999 Bell et al. ..... 463/25
5,931,731 A 8/1999 Chwalisz ..... 453/32
5,934,999 A 8/1999 Valdez ..... 463/17
5,941,771 A 8/1999 Haste, III ..... 463/17
5,957,776 A 9/1999 Hoehne
5,971,851 A 10/1999 Pascal et al.
5,999,808 A 12/1999 LaDue ..... 455/412
6,001,016 A 12/1999 Walker et al.
6,003,651 A 12/1999 Waller et al. ..... 194/202
6,004,205 A 12/1999 Lauretta et al. ..... 463/11
6,019,210 A 2/2000 Matsunaga et al. ..... 194/206
6,019,374 A 2/2000 Breeding ..... 273/292
6,032,955 A 3/2000 Luciano et al. ..... 273/138.1
6,042,150 A 3/2000 Daley
6,045,130 A 4/2000 Jones et al. ..... 273/292
6,048,269 A 4/2000 Burns et al. ..... 463/25
6,056,641 A 5/2000 Webb ..... 463/13
6,059,289 A 5/2000 Vancura ..... 273/143 R
6,062,981 A 5/2000 Luciano, Jr. ..... 463/26
6,066,439 A 5/2000 Nohr et al. ..... 430/347
6,068,553 A 5/2000 Parker ..... 463/27
6,070,878 A 6/2000 Jones et al. ..... 273/309
6,077,161 A 6/2000 Wisler
6,080,063 A 6/2000 Khosla
6,083,105 A 7/2000 Ronin et al. ..... 463/17
6,089,978 A 7/2000 Adams ..... 463/20
6,089,980 A 7/2000 Gauselmann ..... 463/27
6,093,103 A 7/2000 McCrea, Jr. ..... 463/27
6,098,837 A 8/2000 Izawa et al. ..... 221/154
6,099,407 A 8/2000 Parker, Jr. et al. ..... 463/19
6,102,799 A 8/2000 Stupak ..... 463/27
6,104,815 A 8/2000 Alcorn et al.
6,105,747 A 8/2000 Uemizo et al. ..... 194/203
6,106,396 A 8/2000 Alcorn et al.
6,110,041 A 8/2000 Walker et al.
6,110,043 A 8/2000 Olsen ..... 463/27
6,117,012 A 9/2000 McCrea, Jr. ..... 463/27
6,120,377 A 9/2000 McGinnis, Sr. et al. ..... 463/20
6,120,588 A 9/2000 Jacobson ..... 106/31.16
6,123,333 A 9/2000 McGinnis, Sr. et al. ..... 273/146
6,125,195 A 9/2000 Ohya et al. ..... 382/135
6,126,542 A 10/2000 Fier ..... 463/16
6,135,887 A 10/2000 Pease et al.
6,146,273 A 11/2000 Olsen ..... 463/27

(56) References Cited

U.S. PATENT DOCUMENTS 6,149,522 A 11/2000 Alcorn et al.
6,152,822 A 11/2000 Herbert ..... 463/22
6,152,824 A 11/2000 Rothschild et al.
6,165,069 A 12/2000 Sines et al.
6,166,763 A 12/2000 Rhodes et al.
6,168,513 B1 1/2001 Souza et al. ..... 453/57
6,168,523 B1 1/2001 Piechowiak et al. ..... 463/26
6,179,110 B1 1/2001 Ohkawa et al. ..... 194/203
6,179,711 B1 1/2001 Yoseloff ..... 463/25
6,183,366 B1 2/2001 Goldberg et al.
6,186,892 B1 2/2001 Frank et al.
6,186,894 B1 2/2001 Mayeroff ..... 463/20
6,186,895 B1 2/2001 Oliver ..... 463/25
6,190,256 B1 2/2001 Walker et al. ..... 463/25
6,203,430 B1 3/2001 Walker et al. ..... 463/20
6,210,275 B1 4/2001 Olsen ..... 463/16
6,210,277 B1 4/2001 Stefan ..... 463/27
6,213,877 B1 4/2001 Walker et al. ..... 463/26
6,217,447 B1 4/2001 Lofink et al.
6,219,836 B1 4/2001 Wells et al.
6,220,954 B1 4/2001 Nguyen et al. ..... 453/57
6,224,483 B1 5/2001 Mayeroff ..... 463/20
6,224,484 B1 5/2001 Okuda et al. ..... 463/27
6,227,969 B1 5/2001 Yoseloff ..... 463/13
6,227,972 B1 5/2001 Walker et al. ..... 463/25
6,234,898 B1 5/2001 Belamant et al. ..... 463/25
6,244,958 B1 6/2001 Acres ..... 463/26
6,251,014 B1 6/2001 Stockdale et al.
6,254,484 B1 7/2001 McCrea, Jr. ..... 463/27
6,264,109 B1 7/2001 Chapet et al. ..... 235/492
6,264,561 B1 7/2001 Saffari et al.
6,273,424 B1 8/2001 Breeding ..... 273/292
6,275,586 B1 8/2001 Kelly
6,283,856 B1 9/2001 Mothwurf ..... 463/17
6,287,202 B1 9/2001 Pascal et al.
6,290,603 B1 9/2001 Luciano, Jr. ..... 463/25
6,293,864 B1 9/2001 Romero ..... 463/12
6,302,793 B1 10/2001 Fertitta, III et al.
6,309,300 B1 10/2001 Glavich ..... 463/26
6,312,332 B1 11/2001 Walker et al.
6,312,334 B1 11/2001 Yoseloff ..... 463/25
6,315,664 B1 11/2001 Baerlocher et al. ..... 463/21
6,322,078 B1 11/2001 Adams ..... 273/292
6,328,649 B1 12/2001 Randall et al. ..... 463/20
6,334,614 B1 1/2002 Breeding ..... 273/292
6,334,814 B1 1/2002 Adams ..... 463/20
6,336,863 B1 1/2002 Baerlocher et al. ..... 463/27
6,346,043 B1 2/2002 Colin et al. ..... 463/17
6,346,044 B1 2/2002 McCrea, Jr. ..... 463/27
6,347,738 B1 2/2002 Crevelt et al. ..... 235/380
6,350,193 B1 2/2002 Paulsen ..... 453/57
6,352,261 B1 3/2002 Brown ..... 273/288
6,364,767 B1 4/2002 Brossard et al. ..... 463/20
6,371,482 B1 4/2002 Hall, Jr. ..... 273/138.1
6,375,187 B1 4/2002 Baerlocher ..... 273/143 R
6,383,076 B1 5/2002 Tiedeken
6,394,900 B1 5/2002 McGlone et al.
6,394,902 B1 5/2002 Glavich et al. ..... 463/20
6,394,907 B1 5/2002 Rowe ..... 463/42
6,400,272 B1 6/2002 Holtzman et al.
6,406,023 B1 6/2002 Rowe ..... 273/292
6,406,369 B1 6/2002 Baerlocher et al. ..... 463/20
6,409,602 B1 6/2002 Wiltshire et al. ..... 463/42
6,413,161 B1 7/2002 Baerlocher et al. ..... 463/20
6,413,162 B1 7/2002 Baerlocher et al. ..... 463/20
6,416,408 B2 7/2002 Tracy et al. ..... 463/16
6,419,583 B1 7/2002 Crumby et al. ..... 463/42
6,425,824 B1 7/2002 Baerlocher et al. ..... 463/16
6,439,995 B1 8/2002 Hughs-Baird et al. ..... 463/20
6,439,996 B2 8/2002 LeMay et al.
6,443,452 B1 9/2002 Brune ..... 273/143 R
6,443,839 B2 9/2002 Stockdale et al.
6,454,266 B1 9/2002 Breeding et al. ..... 273/292
6,460,848 B1 10/2002 Soltys et al.
6,461,241 B1 10/2002 Webb et al. ..... 463/20
6,464,582 B1 10/2002 Baerlocher et al. ..... 463/20
6,464,584 B2 10/2002 Oliver ..... 463/25
6,468,156 B1 10/2002 Hughs-Baird et al. ..... 463/25
6,471,208 B2 10/2002 Yoseloff et al. ..... 273/143 R
6,471,591 B1 10/2002 Crumby ..... 463/26
6,488,581 B1 12/2002 Stockdale
6,488,585 B1 12/2002 Wells et al.
6,494,454 B2 12/2002 Adams ..... 273/292
6,494,785 B1 12/2002 Gerrard et al. ..... 463/20
6,497,408 B1 12/2002 Walker et al. ..... 273/138.1
6,503,147 B1 1/2003 Stockdale et al.
6,505,772 B1 1/2003 Mollett et al. ..... 235/379
6,506,118 B1 1/2003 Baerlocher et al. ..... 463/25
6,508,709 B1 1/2003 Karmarkar ..... 463/42
6,508,710 B1 1/2003 Paravia et al.
6,511,375 B1 1/2003 Kaminkow ..... 463/20
6,514,141 B1 2/2003 Kaminkow et al. ..... 463/25
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,527,638 B1 3/2003 Walker et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,547,131 B1 4/2003 Foodman et al. ..... 235/380
6,561,900 B1 5/2003 Baerlocher et al. ..... 463/20
6,565,433 B1 5/2003 Baerlocher et al. ..... 463/20
6,565,436 B1 5/2003 Baerlocher ..... 463/26
6,569,015 B1 5/2003 Baerlocher et al. ..... 463/16
6,572,472 B1 6/2003 Glavich ..... 463/16
6,572,473 B1 6/2003 Baerlocher ..... 463/20
6,575,829 B2 6/2003 Coleman et al. ..... 463/20
6,575,833 B1 6/2003 Stockdale
6,575,834 B1 6/2003 Lindo ..... 463/40
6,578,847 B1 6/2003 Hedrick et al. ..... 273/138.2
6,579,179 B2 6/2003 Poole et al. ..... 463/25
6,579,180 B2 6/2003 Soltys et al.
6,579,181 B2 6/2003 Soltys et al.
6,581,747 B1 6/2003 Charlier et al.
6,582,306 B1 6/2003 Kaminkow ..... 463/20
6,582,307 B2 6/2003 Webb ..... 463/22
6,585,588 B2 7/2003 Hartl ..... 463/16
6,585,591 B1 7/2003 Baerlocher et al. ..... 463/25
6,585,592 B1 7/2003 Crumby ..... 463/26
6,585,598 B2 7/2003 Nguyen et al. ..... 463/41
6,592,458 B1 7/2003 Ho ..... 463/17
6,595,854 B2 7/2003 Hughs-Baird et al. ..... 463/20
6,595,857 B2 7/2003 Soltys et al.
6,599,185 B1 7/2003 Kaminkow et al. ..... 463/16
6,599,192 B1 7/2003 Baerlocher et al. ..... 463/25
6,599,193 B2 7/2003 Baerlocher et al. ..... 463/27
6,602,135 B1 8/2003 Gerrard ..... 463/16
6,602,136 B1 8/2003 Baerlocher et al. ..... 463/16
6,602,137 B2 8/2003 Kaminkow et al. ..... 463/16
6,605,000 B2 8/2003 Adams ..... 463/20
6,607,438 B2 8/2003 Baerlocher et al. ..... 463/16
6,607,441 B1 8/2003 Acres ..... 463/25
6,609,974 B2 8/2003 Mead et al. ..... 463/25
6,609,978 B1 8/2003 Paulsen
6,612,928 B1 9/2003 Bradford et al.
6,620,046 B2 9/2003 Rowe ..... 463/25
6,620,047 B1 9/2003 Alcorn et al. ..... 463/37
6,629,184 B1 9/2003 Berg et al.
6,629,591 B1 10/2003 Griswold et al. ..... 194/205
6,632,139 B1 10/2003 Baerlocher ..... 463/16
6,634,943 B1 10/2003 Baerlocher ..... 463/25
6,634,945 B2 10/2003 Glavich et al. ..... 463/25
6,638,161 B2 10/2003 Soltys et al. ..... 463/12
6,638,164 B2 10/2003 Randall et al. ..... 463/20
6,638,170 B1 10/2003 Crumby
6,641,484 B2 11/2003 Oles et al.
6,645,073 B2 11/2003 Lemay et al. ..... 463/20
6,645,077 B2 11/2003 Rowe
6,648,753 B1 11/2003 Tracy et al. ..... 463/16
6,648,754 B2 11/2003 Baerlocher et al. ..... 463/17
6,651,985 B2 11/2003 Sines et al. ..... 273/309
6,652,378 B2 11/2003 Cannon et al.

(56) References Cited

U.S. PATENT DOCUMENTS 6,656,048 B2 12/2003 Olsen
6,659,461 B2 12/2003 Yoseloff et al. ..... 273/274
6,659,864 B2 12/2003 McGahn et al. ..... 463/16
6,663,488 B1 12/2003 Adams ..... 463/17
6,663,489 B2 12/2003 Baerlocher ..... 463/20
6,663,490 B2 12/2003 Soltys et al.
6,669,559 B1 12/2003 Baerlocher et al. ..... 463/16
6,675,152 B1 1/2004 Prasad et al.
6,676,522 B2 1/2004 Rowe et al. ..... 463/42
6,682,423 B2 1/2004 Brosnan et al.
6,685,564 B2 2/2004 Oliver ..... 463/25
6,685,567 B2 2/2004 Cockerille et al.
6,688,975 B2 2/2004 Baerlocher et al. ..... 463/16
6,688,977 B1 2/2004 Baerlocher et al. ..... 463/25
6,688,979 B2 2/2004 Soltys et al.
6,692,354 B2 2/2004 Tracy et al. ..... 463/16
6,692,355 B2 2/2004 Baerlocher et al. ..... 463/16
6,699,128 B1 3/2004 Beadell et al.
6,702,291 B2 3/2004 Grebler et al.
6,709,324 B1 3/2004 Beadell ..... 453/29
6,712,695 B2 3/2004 Mothwurf et al.
6,712,696 B2 3/2004 Soltys et al.
6,718,361 B1 4/2004 Basani et al.
6,719,632 B2 4/2004 Palmer et al. ..... 463/25
6,722,974 B2 4/2004 Sines et al. ..... 463/12
6,722,981 B2 4/2004 Kaminkow et al. ..... 463/25
6,722,982 B2 4/2004 Kaminkow et al. ..... 463/25
6,722,983 B2 4/2004 Kaminkow et al. ..... 463/26
6,726,563 B1 4/2004 Baerlocher et al. ..... 463/25
6,726,565 B2 4/2004 Hughs-Baird ..... 463/25
6,728,740 B2 4/2004 Kelly et al.
6,733,386 B2 5/2004 Cuddy et al. ..... 463/17
6,733,389 B2 5/2004 Webb et al. ..... 463/20
6,736,250 B2 5/2004 Mattice ..... 194/203
6,739,975 B2 5/2004 Nguyen et al. ..... 463/39
6,743,102 B1 6/2004 Fiechter et al.
6,745,330 B1 6/2004 Maillot
6,746,330 B2 6/2004 Cannon ..... 463/25
6,749,504 B2 6/2004 Hughs-Baird ..... 463/25
6,749,515 B2 6/2004 Hedrick et al. ..... 463/46
6,752,312 B1 6/2004 Chamberlain et al. ..... 235/375
6,755,741 B1 6/2004 Rafaeli ..... 463/25
6,758,747 B2 7/2004 Baerlocher ..... 463/16
6,758,750 B2 7/2004 Baerlocher et al. ..... 463/25
6,758,751 B2 7/2004 Soltys et al.
6,769,983 B2 8/2004 Slomiany ..... 463/16
6,789,801 B2 9/2004 Snow ..... 273/292
6,800,029 B2 10/2004 Rowe et al. ..... 463/25
6,808,173 B2 10/2004 Snow ..... 273/292
6,811,488 B2 11/2004 Paravia et al.
6,817,948 B2 11/2004 Pascal et al.
6,823,419 B2 11/2004 Berg et al.
6,837,789 B2 1/2005 Garahi et al. ..... 463/29
6,846,238 B2 1/2005 Wells
6,848,994 B1 2/2005 Knust et al.
6,866,581 B2 3/2005 Martinek et al.
6,866,586 B2 3/2005 Oberberger et al. ..... 463/42
6,874,681 B1 4/2005 Izawa et al. ..... 235/379
6,874,786 B2 4/2005 Bruno et al. ..... 273/306
6,884,173 B2 4/2005 Gauselmann
6,884,174 B2 4/2005 Lundy et al.
6,896,618 B2 5/2005 Benoy et al.
6,899,627 B2 5/2005 Lam et al.
6,905,411 B2 6/2005 Nguyen et al. ..... 463/25
6,908,387 B2 6/2005 Hedrick et al.
6,923,446 B2 8/2005 Snow ..... 273/292
6,938,900 B2 9/2005 Snow ..... 273/292
6,955,599 B2 10/2005 Bourbour et al. ..... 463/13
6,960,134 B2 11/2005 Hartl et al. ..... 463/20
6,962,530 B2 11/2005 Jackson
6,971,956 B2 12/2005 Rowe et al. ..... 463/25
6,972,682 B2 12/2005 Lareau et al.
6,986,514 B2 1/2006 Snow ..... 273/292
6,991,540 B2 1/2006 Marlow ..... 463/16
6,991,544 B2 1/2006 Soltys et al. ..... 463/42
6,993,587 B1 1/2006 Basani et al.
6,997,803 B2 2/2006 LeMay et al.
7,000,921 B2 2/2006 Schultz ..... 273/292
7,025,674 B2 4/2006 Adams et al.
7,035,626 B1 4/2006 Luciano, Jr.
7,037,195 B2 5/2006 Schneider et al. ..... 463/25
7,050,056 B2 5/2006 Meyringer
7,062,470 B2 6/2006 Prasad et al.
7,063,617 B2 6/2006 Brosnan et al. ..... 463/25
7,077,332 B2 7/2006 Verschuur et al. ..... 235/492
7,086,947 B2 8/2006 Walker et al.
7,099,035 B2 8/2006 Brooks et al.
7,112,138 B2 9/2006 Hedrick et al.
7,114,718 B2 10/2006 Grauzer et al.
7,116,782 B2 10/2006 Jackson et al.
7,147,558 B2 12/2006 Giobbi
7,168,089 B2 1/2007 Nguyen et al.
7,179,170 B2 2/2007 Martinek et al.
7,186,181 B2 3/2007 Rowe
7,197,765 B2 3/2007 Chan et al.
7,198,571 B2 4/2007 LeMay et al.
RE39,644 E 5/2007 Alcorn et al.
7,291,068 B2 11/2007 Bryant et al. ..... 463/25
7,303,475 B2 12/2007 Britt et al.
7,309,065 B2 12/2007 Yoseloff et al. ..... 273/292
7,311,605 B2 12/2007 Moser
7,329,185 B2 2/2008 Conover et al.
7,330,822 B1 2/2008 Robson et al.
7,331,520 B2 2/2008 Silva et al.
7,331,579 B2 2/2008 Snow ..... 273/292
7,346,682 B2 3/2008 Basani et al.
7,349,920 B1 3/2008 Feinberg et al.
7,351,147 B2 4/2008 Stockdale et al.
7,356,770 B1 4/2008 Jackson
7,363,342 B1 4/2008 Wang et al.
7,364,510 B2 4/2008 Walker et al.
7,370,282 B2 5/2008 Cary
7,384,339 B2 6/2008 LeMay et al.
7,390,256 B2 6/2008 Soltys et al. ..... 463/12
7,398,327 B2 7/2008 Lee
7,410,422 B2 8/2008 Fine
7,419,428 B2 9/2008 Rowe ..... 463/25
7,427,233 B2 9/2008 Walker et al.
7,427,234 B2 9/2008 Soltys et al. ..... 463/16
7,427,236 B2 9/2008 Kaminkow et al.
7,434,805 B2 10/2008 Grauzer et al.
7,435,179 B1 10/2008 Ford
7,438,643 B2 10/2008 Brosnan et al.
7,448,626 B2 11/2008 Fleckenstein ..... 273/149 R
7,455,591 B2 11/2008 Nguyen
7,460,863 B2 12/2008 Steelberg et al.
7,465,231 B2 12/2008 Lewin et al.
7,473,178 B2 1/2009 Boyd et al.
7,483,394 B2 1/2009 Chang et al.
7,494,413 B2 2/2009 Singer et al. ..... 463/20
7,500,915 B2 3/2009 Wolf et al.
7,510,186 B2 3/2009 Fleckenstein ..... 273/149 R
7,510,194 B2 3/2009 Soltys et al. ..... 273/293
7,510,474 B2 3/2009 Carter, Sr.
7,515,718 B2 4/2009 Nguyen et al.
7,534,169 B2 5/2009 Amaitis et al.
7,549,576 B2 6/2009 Alderucci et al.
7,559,080 B2 7/2009 Bhargavan et al.
7,566,274 B2 7/2009 Johnson et al.
7,575,234 B2 8/2009 Soltys et al.
7,577,847 B2 8/2009 Nguyen et al.
7,578,739 B2 8/2009 Gauselmann
7,581,256 B2 8/2009 Cockerille et al.
7,585,217 B2 9/2009 Lutnick et al.
7,607,976 B2 10/2009 Baerlocher et al.
7,607,977 B2 10/2009 Baerlocher et al.
7,611,407 B1 11/2009 Itkis et al.
7,611,409 B2 11/2009 Muir et al.
7,617,151 B2 11/2009 Rowe
7,618,317 B2 11/2009 Jackson
7,621,809 B2 11/2009 Baerlocher et al.
7,629,886 B2 12/2009 Steeves
7,634,550 B2 12/2009 Wolber et al.
7,637,810 B2 12/2009 Amaitis et al.

(56) References Cited

U.S. PATENT DOCUMENTS 7,644,861 B2 1/2010 Alderucci et al.
7,648,414 B2 1/2010 McNutt et al.
7,666,081 B2 2/2010 Baerlocher et al.
7,682,249 B2 3/2010 Winans et al.
7,684,874 B2 3/2010 Schlottmann et al.
7,685,593 B2 3/2010 Solomon et al.
7,686,688 B2 3/2010 Friedman et al.
7,690,995 B2 4/2010 Frankulin et al.
7,699,697 B2 4/2010 Darrah et al.
7,699,703 B2 4/2010 Muir et al.
7,702,719 B1 4/2010 Betz et al.
7,722,453 B2 5/2010 Lark et al.
7,730,198 B2 6/2010 Ruppert et al.
7,744,462 B2 6/2010 Grav et al.
7,747,741 B2 6/2010 Basani et al.
7,753,790 B2 7/2010 Nguyen et al.
7,769,877 B2 8/2010 McBride et al.
7,778,635 B2 8/2010 Crookham et al.
7,780,525 B2 8/2010 Walker et al.
7,780,526 B2 8/2010 Nguyen et al.
7,780,529 B2 8/2010 Rowe et al.
7,783,881 B2 8/2010 Morrow et al.
7,785,204 B2 8/2010 Wells et al.
7,824,267 B2 11/2010 Cannon et al.
7,828,649 B2 11/2010 Cuddy et al.
7,841,946 B2 11/2010 Walker et al.
7,846,020 B2 12/2010 Walker et al.
7,850,528 B2 12/2010 Wells
7,862,425 B2 1/2011 Cavagna
7,867,081 B2 1/2011 Schneider et al.
7,874,920 B2 1/2011 Hornik et al.
7,874,921 B2 1/2011 Baszucki et al.
7,892,093 B2 2/2011 Kniesteadt et al.
7,898,679 B2 3/2011 Brack et al.
7,901,294 B2 3/2011 Walker et al.
7,905,780 B2 3/2011 Morrow et al.
7,931,533 B2 4/2011 LeMay et al.
7,937,464 B2 5/2011 Ruppert et al.
7,963,847 B2 6/2011 Baerlocher
8,070,597 B2 * 12/2011 Cuddy ..... 463/27
8,075,396 B2 12/2011 Roemer
8,267,773 B2 9/2012 Jaffe et al.
8,267,797 B2 9/2012 Thomas et al.
2001/0019966 A1 9/2001 Idaka ..... 463/40
2002/0084587 A1 7/2002 Bennett et al. ..... 273/309
2002/0086725 A1 * 7/2002 Fasbender et al. ..... 463/11
2002/0111210 A1 8/2002 Luciano, Jr. et al. ..... 463/29
2002/0111213 A1 8/2002 McEntee et al.
2002/0113371 A1 8/2002 Snow
2002/0115487 A1 8/2002 Wells ..... 463/42
2002/0142844 A1 10/2002 Kerr ..... 463/42
2002/0195773 A1 12/2002 Dunn ..... 273/274
2003/0004871 A1 1/2003 Rowe
2003/0022714 A1 1/2003 Oliver ..... 463/25
2003/0027625 A1 2/2003 Rowe ..... 463/20
2003/0032474 A1 2/2003 Kaminkow
2003/0036425 A1 2/2003 Kaminkow et al. ..... 463/25
2003/0042679 A1 3/2003 Snow ..... 273/292
2003/0045354 A1 3/2003 Giobbi ..... 463/40
2003/0064798 A1 4/2003 Grauzer et al. ..... 463/29
2003/0075869 A1 4/2003 Breeding et al. ..... 273/292
2003/0090064 A1 5/2003 Hoyt et al.
2003/0104865 A1 6/2003 Itkis et al. ..... 463/39
2003/0130024 A1 7/2003 Darby
2003/0186739 A1 10/2003 Paulsen et al. ..... 463/25
2003/0203755 A1 10/2003 Jackson
2003/0206548 A1 11/2003 Bannai et al.
2003/0224858 A1 12/2003 Yoseloff et al.
2003/0232651 A1 12/2003 Huard et al.
2003/0236110 A1 * 12/2003 Beaulieu et al. ..... 463/1
2004/0002386 A1 1/2004 Wolfe et al.
2004/0002388 A1 1/2004 Larsen et al.
2004/0029635 A1 2/2004 Giobbi ..... 463/30
2004/0033095 A1 2/2004 Saffari et al. ..... 400/120.01
2004/0043815 A1 3/2004 Kaminkow ..... 463/25
2004/0043820 A1 3/2004 Schlottmann
2004/0048671 A1 3/2004 Rowe
2004/0082385 A1 4/2004 Silva et al.
2004/0087375 A1 5/2004 Gelinotte ..... 463/47
2004/0090003 A1 5/2004 Snow ..... 273/274
2004/0092310 A1 5/2004 Brosnan et al.
2004/0106452 A1 6/2004 Nguyen et al.
2004/0110119 A1 6/2004 Riconda et al.
2004/0127291 A1 7/2004 George et al.
2004/0132529 A1 7/2004 Mkrtchyan et al. ..... 463/29
2004/0133485 A1 7/2004 Schoonmaker et al.
2004/0142744 A1 7/2004 Atkinson et al.
2004/0150702 A1 8/2004 Tsuyoshi et al. ..... 347/100
2004/0166918 A1 8/2004 Walker et al. ..... 463/16
2004/0166940 A1 8/2004 Rothschild
2004/0185936 A1 9/2004 Block et al.
2004/0259618 A1 12/2004 Soltys et al. ..... 463/11
2005/0043094 A1 2/2005 Nguyen et al. ..... 463/42
2005/0054438 A1 3/2005 Rothschild et al. ..... 463/29
2005/0054445 A1 3/2005 Gatto et al.
2005/0055113 A1 3/2005 Gauselmann ..... 700/91
2005/0059479 A1 3/2005 Soltys et al. ..... 463/25
2005/0070358 A1 3/2005 Angell et al. ..... 463/39
2005/0101383 A1 5/2005 Wells
2005/0116417 A1 6/2005 Soltys et al. ..... 273/292
2005/0119052 A1 6/2005 Russell et al.
2005/0143166 A1 6/2005 Walker et al. ..... 463/25
2005/0153778 A1 7/2005 Nelson et al.
2005/0176502 A1 8/2005 Nishimura et al.
2005/0181856 A1 8/2005 Cannon et al. ..... 463/16
2005/0181864 A1 8/2005 Britt et al. ..... 463/25
2005/0215311 A1 9/2005 Hornik et al. ..... 463/20
2005/0221882 A1 10/2005 Nguyen et al. ..... 463/16
2005/0222891 A1 10/2005 Chan et al.
2005/0227760 A1 10/2005 Vlazny et al. ..... 463/28
2005/0239542 A1 10/2005 Olsen ..... 463/27
2005/0266919 A1 12/2005 Rowe et al. ..... 463/25
2005/0282626 A1 12/2005 Manfredi et al.
2006/0004618 A1 1/2006 Brixius
2006/0009282 A1 1/2006 George et al. ..... 463/29
2006/0015716 A1 1/2006 Thornton et al.
2006/0019745 A1 1/2006 Benbrahim ..... 463/29
2006/0026499 A1 2/2006 Weddle
2006/0035707 A1 2/2006 Nguyen et al.
2006/0046849 A1 3/2006 Kovacs ..... 463/39
2006/0116208 A1 6/2006 Chen et al.
2006/0121970 A1 6/2006 Khal ..... 463/16
2006/0183541 A1 8/2006 Okada et al. ..... 463/29
2006/0195847 A1 8/2006 Amano et al.
2006/0205508 A1 9/2006 Green
2006/0211481 A1 9/2006 Soltys et al. ..... 463/16
2006/0247013 A1 11/2006 Walker et al. ..... 463/20
2006/0247057 A1 11/2006 Green et al.
2006/0248161 A1 11/2006 O'Brien et al.
2006/0277487 A1 12/2006 Poulsen et al.
2006/0287077 A1 12/2006 Grav et al. ..... 463/27
2007/0004500 A1 1/2007 Soltys et al. ..... 463/22
2007/0004501 A1 1/2007 Brewer et al.
2007/0015583 A1 1/2007 Tran ..... 463/40
2007/0026935 A1 2/2007 Wolf et al.
2007/0033247 A1 2/2007 Martin
2007/0054725 A1 3/2007 Morrow et al. ..... 463/16
2007/0054740 A1 3/2007 Salls et al.
2007/0057453 A1 3/2007 Soltys et al. ..... 273/149 P
2007/0057454 A1 3/2007 Fleckenstein ..... 273/149 R
2007/0057462 A1 3/2007 Fleckenstein ..... 273/274
2007/0057466 A1 3/2007 Soltys et al. ..... 273/292
2007/0057469 A1 3/2007 Grauzer et al.
2007/0060259 A1 3/2007 Pececnik
2007/0060260 A1 3/2007 Fleckenstein ..... 463/16
2007/0060307 A1 3/2007 Mathis et al.
2007/0060365 A1 3/2007 Tien et al. ..... 463/42
2007/0077990 A1 4/2007 Cuddy et al. ..... 463/25
2007/0077995 A1 4/2007 Oak et al.
2007/0093298 A1 4/2007 Brunet
2007/0105628 A1 5/2007 Arbogast et al.
2007/0111775 A1 5/2007 Yoseloff ..... 463/16
2007/0111791 A1 5/2007 Arbogast et al.
2007/0111794 A1 5/2007 Hogan et al.

(56) References Cited

U.S. PATENT DOCUMENTS

| | | | | |
|---|---|---|---|---|
| 2007/0117608 | A1 | 5/2007 | Roper et al. | 463/16 |
| 2007/0124483 | A1 | 5/2007 | Marples et al. | |
| 2007/0129145 | A1 | 6/2007 | Blackburn et al. | |
| 2007/0150329 | A1 | 6/2007 | Brook et al. | |
| 2007/0167235 | A1 | 7/2007 | Naicker | 463/42 |
| 2007/0191102 | A1 | 8/2007 | Coliz et al. | |
| 2007/0192748 | A1 | 8/2007 | Martin et al. | |
| 2007/0198418 | A1 | 8/2007 | MacDonald | 705/52 |
| 2007/0208816 | A1 | 9/2007 | Baldwin et al. | |
| 2007/0218998 | A1 | 9/2007 | Arbogast et al. | |
| 2007/0235521 | A1 | 10/2007 | Mateen et al. | 235/379 |
| 2007/0241497 | A1 | 10/2007 | Soltys et al. | 273/149 R |
| 2007/0241498 | A1 | 10/2007 | Soltys | 273/149 R |
| 2007/0243925 | A1 | 10/2007 | LeMay et al. | 463/20 |
| 2007/0243927 | A1 | 10/2007 | Soltys | 463/25 |
| 2007/0243935 | A1 | 10/2007 | Huizinga | 463/42 |
| 2007/0259709 | A1 | 11/2007 | Kelly et al. | |
| 2007/0259711 | A1 | 11/2007 | Thomas | 463/22 |
| 2007/0287535 | A1 | 12/2007 | Soltys | 463/29 |
| 2007/0298865 | A1 | 12/2007 | Soltys | 463/22 |
| 2007/0298868 | A1 | 12/2007 | Soltys | 463/25 |
| 2008/0004108 | A1 | 1/2008 | Klinkhammer | |
| 2008/0009344 | A1 | 1/2008 | Graham et al. | |
| 2008/0026832 | A1 | 1/2008 | Stevens et al. | |
| 2008/0026848 | A1 | 1/2008 | Byng | |
| 2008/0038035 | A1 | 2/2008 | Shuldman et al. | |
| 2008/0045341 | A1 | 2/2008 | Englman | |
| 2008/0045344 | A1 | 2/2008 | Schlottmann et al. | 463/25 |
| 2008/0064501 | A1 | 3/2008 | Patel | |
| 2008/0076572 | A1 | 3/2008 | Nguyen et al. | |
| 2008/0090651 | A1 | 4/2008 | Baerlocher | 463/27 |
| 2008/0096659 | A1 | 4/2008 | Kreloff et al. | |
| 2008/0108433 | A1 | 5/2008 | DiMichele et al. | |
| 2008/0113704 | A1 | 5/2008 | Jackson | 463/13 |
| 2008/0113764 | A1 | 5/2008 | Soltys | 463/22 |
| 2008/0113773 | A1 | 5/2008 | Johnson et al. | |
| 2008/0113793 | A1 | 5/2008 | Miyamoto et al. | |
| 2008/0117339 | A1 | 5/2008 | Kirsche | |
| 2008/0119284 | A1 | 5/2008 | Luciano, Jr. et al. | |
| 2008/0146337 | A1 | 6/2008 | Halonen et al. | 463/42 |
| 2008/0153599 | A1 | 6/2008 | Atashband et al. | |
| 2008/0153600 | A1 | 6/2008 | Swarna | |
| 2008/0154916 | A1 | 6/2008 | Atashband | |
| 2008/0155665 | A1 | 6/2008 | Ruppert et al. | |
| 2008/0162729 | A1 | 7/2008 | Ruppert | |
| 2008/0171588 | A1 | 7/2008 | Atashband | |
| 2008/0171598 | A1 | 7/2008 | Deng | |
| 2008/0200255 | A1 | 8/2008 | Eisele | |
| 2008/0243697 | A1 | 10/2008 | Irving et al. | |
| 2008/0261701 | A1 | 10/2008 | Lewin et al. | |
| 2008/0287197 | A1 | 11/2008 | Ruppert et al. | |
| 2008/0293494 | A1 | 11/2008 | Adiraju et al. | |
| 2008/0311971 | A1 | 12/2008 | Dean | |
| 2008/0318685 | A9 | 12/2008 | Oak et al. | |
| 2009/0005176 | A1 | 1/2009 | Morrow et al. | 463/43 |
| 2009/0011833 | A1 | 1/2009 | Seelig et al. | |
| 2009/0029775 | A1 | 1/2009 | Ruppert et al. | |
| 2009/0031008 | A1 | 1/2009 | Elliott et al. | |
| 2009/0104977 | A1* | 4/2009 | Zielinski | 463/25 |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0118006 | A1 | 5/2009 | Kelly et al. | 463/31 |
| 2009/0124392 | A1 | 5/2009 | Ruppert et al. | |
| 2009/0124394 | A1 | 5/2009 | Swarna | |
| 2009/0125603 | A1 | 5/2009 | Atashband et al. | |
| 2009/0131144 | A1 | 5/2009 | Allen | |
| 2009/0131163 | A1 | 5/2009 | Arbogast et al. | |
| 2009/0132720 | A1 | 5/2009 | Ruppert et al. | |
| 2009/0170594 | A1 | 7/2009 | Delaney et al. | 463/25 |
| 2009/0176556 | A1 | 7/2009 | Gagner et al. | |
| 2009/0176580 | A1 | 7/2009 | Herrmann et al. | |
| 2009/0181776 | A1 | 7/2009 | Deng | |
| 2009/0253483 | A1 | 10/2009 | Pacey et al. | |
| 2009/0270170 | A1 | 10/2009 | Patton | |
| 2009/0275374 | A1 | 11/2009 | Nelson et al. | 463/16 |
| 2009/0275393 | A1 | 11/2009 | Kisenwether et al. | 463/25 |
| 2009/0275394 | A1 | 11/2009 | Young et al. | 463/25 |
| 2009/0275398 | A1 | 11/2009 | Nelson | 463/27 |
| 2009/0275399 | A1 | 11/2009 | Kelly et al. | 463/27 |
| 2009/0275400 | A1 | 11/2009 | Rehm et al. | 463/27 |
| 2009/0275401 | A1 | 11/2009 | Allen et al. | |
| 2009/0275402 | A1 | 11/2009 | Backover et al. | |
| 2009/0275407 | A1 | 11/2009 | Singh et al. | 463/31 |
| 2009/0275410 | A1 | 11/2009 | Kisenwether et al. | 463/42 |
| 2009/0275411 | A1 | 11/2009 | Kisenwether et al. | 463/42 |
| 2009/0276341 | A1 | 11/2009 | McMahan et al. | |
| 2009/0298583 | A1 | 12/2009 | Jones | |
| 2009/0307069 | A1 | 12/2009 | Meyerhofer | |
| 2010/0016067 | A1 | 1/2010 | White et al. | |
| 2010/0016068 | A1 | 1/2010 | White et al. | |
| 2010/0029385 | A1 | 2/2010 | Garvey et al. | |
| 2010/0048291 | A1 | 2/2010 | Warkentin | |
| 2010/0093441 | A1 | 4/2010 | Rajaraman et al. | |
| 2010/0124990 | A1 | 5/2010 | Crowder | |
| 2010/0125851 | A1 | 5/2010 | Singh et al. | |
| 2010/0130280 | A1 | 5/2010 | Arezina et al. | |
| 2010/0131772 | A1 | 5/2010 | Atashband et al. | |
| 2010/0137056 | A1 | 6/2010 | Hoffman et al. | |
| 2010/0151926 | A1 | 6/2010 | Ruppert et al. | |
| 2010/0161798 | A1 | 6/2010 | Ruppert et al. | |
| 2010/0234104 | A1 | 9/2010 | Ruppert et al. | |
| 2010/0248842 | A1 | 9/2010 | Ruppert | |
| 2011/0009184 | A1 | 1/2011 | Byng | |
| 2011/0124417 | A1 | 5/2011 | Baynes et al. | |

FOREIGN PATENT DOCUMENTS

| | | | |
|---|---|---|---|
| EP | 0 700 980 | B1 | 11/1999 |
| EP | 1074955 | A2 | 2/2001 |
| EP | 1463008 | A2 | 9/2004 |
| GB | 2 370 791 | A | 7/2002 |
| JP | 8255059 | | 10/1996 |
| KR | 2001-0084838 | | 9/2001 |
| KR | 2002-0061793 | | 7/2002 |
| KR | 2003-0091635 | | 12/2003 |
| WO | 97/36658 | A1 | 10/1997 |
| WO | 00/22585 | A2 | 4/2000 |
| WO | 02/05914 | | 1/2002 |
| WO | 03/060846 | A2 | 7/2003 |
| WO | 2005/035084 | A1 | 4/2005 |
| WO | 2006/110348 | | 10/2006 |
| WO | 2007/033207 | A2 | 3/2007 |

OTHER PUBLICATIONS

Mikohn, "Tablelink™, The New Standard in Table Games," before Jan. 1, 2004, 14 pages.

White et al., Entitled "Networked Gaming System With Enterprise Accounting Methods and Apparatus", U.S. Appl. No. 12/470,349, filed May 21, 2009, 411 pages.

White et al., Entitled "Networked Gaming System With Enterprise Accounting Methods and Apparatus", U.S. Appl. No. 12/470,353, filed May 21, 2009, 410 pages.

International Search Report, mailed Dec. 22, 2009 for PCT/US2009/042149, 3 pages.

Written Opinion, mailed Dec. 22, 2009, for PCT/US2009/042149, 3 pages.

Bally TMS, "MP21—Automated Table Tracking/Features," 2 pages, Nov. 2005.

Bally TMS, "MPBacc—Specifications/Specifications," 2 pages, Nov. 2005.

Bally TMS, "MPLite—Table Management System/Features," 2 pages, Nov. 2005.

Bulaysky, J., "Tracking the Tables," *Casino Journal*, May 2004, pp. 44-47, accessed Dec. 21, 2005, URL=http://www.ascendgaming.com/cj/vendors_manufacturers_table/Trackin916200411141AM.htm, 5 pages.

Burke, A., "Tracking the Tables," reprinted from *International Gaming & Wagering Business*, Aug. 2003, 4 pages.

(56) References Cited

OTHER PUBLICATIONS

Crowder, "Apparatus, Method, and System to Provide a Multiple Processor Architecture for Server-Based Gaming," Amendment dated Aug. 5, 2011 for U.S. Appl. No. 12/271,736, 18 pages.
Crowder, "Apparatus, Method, and System to Provide a Multiple Processor Architecture for Server-Based Gaming," Office Action dated May 5, 2011 for U.S. Appl. No. 12/271,736, 10 pages.
Crowder, "Apparatus, Method, and System to Provide a Multiple Processor Architecture for Server-Based Gaming," Notice of Allowance dated May 16, 2012, for U.S. Appl. No. 12/271,736, 9 pages.
Gros, R., "All You Ever Wanted to Know About Table Games," reprinted from *Global Gaming Business*, Aug. 1, 2003, 2 pages.
MagTek, "Port Powered Swipe Reader," Technical Reference Manual, Manual Part No. 99875094 Rev 12, Jun. 2003, 20 pages.
Singh et al., "Apparatus, Method, and System to Provide a Multi-Core Processor for an Electronic Gaming Machine (EGM)," Advisory Action dated Jul. 25, 2012, for U.S. Appl. No. 12/271,337, 4 pages.
Singh et al., "Apparatus, Method, and System to Provide a Multi-Core Processor for an Electronic Gaming Machine (EGM)," Amendment dated Mar. 7, 2012, for U.S. Appl. No. 12/271,337, 11 pages.
Singh et al., "Apparatus, Method, and System to Provide a Multi-Core Processor for an Electronic Gaming Machine (EGMm)," Amendment dated Jul. 16, 2012, for U.S. Appl. No. 12/271,337, 8 pages.
Singh et al., "Apparatus, Method, and System to Provide a Multi-Core Processor for an Electronic Gaming Machine (EGM)," Amendment dated Aug. 16, 2012, for U.S. Appl. No. 12/271,337, 8 pages.
Singh et al., "Apparatus, Method, and System to Provide a Multi-Core Processor for an Electronic Gaming Machine (EGM)," Office Action dated Dec. 7, 2011, for U.S. Appl. No. 12/271,337, 9 pages.
Singh et al., "Apparatus, Method, and System to Provide a Multi-Core Processor for an Electronic Gaming Machine (EGM)," Office Action dated Mar. 16, 2012, for U.S. Appl. No. 12/271,337, 10 pages.
Singh et al., "Apparatus, Method, and System to Provide a Multi-Core Processor for an Electronic Gaming Machine (EGM)," Notice of Allowance dated Aug. 30, 2012, for U.S. Appl. No. 12/271,337, 7 pages.
Terdiman, D., "Who's Holding the Aces Now?", reprinted from *Wired News*, Aug. 18, 2003, 2 pages.
Winkler, C., "Product Spotlight: MindPlay," reprinted from *Gaming and Leisure Technology*, Fall 2003, 2 pages.

* cited by examiner

SYSTEMS, METHODS, AND DEVICES FOR PROVIDING INSTANCES OF A SECONDARY GAME

BACKGROUND

1. Technical Field

This disclosure generally relates to the field of games and more particularly to providing instances of a secondary game by a gaming machine configured to provide instances of a primary game and instances of a secondary game.

2. Description of the Related Art

Today, modern game-entertainment centers such as casinos provide electronic gaming machines which offer various games to players. Some electronic gaming machines may be configured to provide a primary game and a secondary game. For example, in a casino environment, a gaming machine may provide a slot-based game as the primary game of the gaming machine. A patron, player, of the casino may insert money into the gaming machine to purchase an instance of the slot-based game. The gaming machine may be further configured to provide the player with an instance of a secondary game based on an outcome of the primary game. For example, the gaming machine may provide the player with an instance of the secondary game when the outcome of the primary game is three-of-a-kind, e.g., three "bells." The secondary game may be a different game title (e.g., an electronic game of roulette) or may be the same type of game as the primary game (e.g., a slot-based game) that may have different odds for winning and/or different payout amount.

For games of chance such as slot-based games, a player may have to play multiple instances of the primary game until the outcome of a primary game matches the conditions for triggering an instance of the secondary game. The player may truly desire to play the secondary game and may get frustrated and/or get bored playing the primary game, which may cause the player to leave the game-entertainment center prior to the player satisfying his/her desire to play the secondary game. Additionally, the player may run out of money and/or run out of time playing the primary game such that the players desire to play the secondary game is unfulfilled. In any case, unless the player has sufficient opportunity to satisfy his/her desire to play the secondary game, the player may quit playing the gaming machine or avoid playing the gaming machine in the future.

There is a need for systems, methods, and devices that address the problems with current gaming machines.

BRIEF SUMMARY

In one aspect, a method for enhancing gaming at a gaming machine configured to provide instances of gameplay of a primary game and selectively provide instances of gameplay of a secondary game includes: providing a secondary game buy-in option to a first respective instance of a secondary game that is triggerable based at least on at least one outcome of a primary game based at least on a determined current number of available credits; selectively providing the first respective instance of the secondary game based at least on player-input indicative of acceptance of the secondary game buy-in option; debiting a respective first number of credits from the current number of available credits based at least on the player-input indicative of acceptance of the secondary game buy-in option; selectively providing a respective instance of the primary game based at least on the current number of available credits; debiting a respective second number of credits from the current number of available credits based at least on the provisioning a player with the respective instance of the primary game; and from time-to-time, providing the secondary game buy-in option to a second respective instance of the secondary game based at least on respective outcomes of at least one instance of the primary game.

In one aspect, a method for enhancing gaming at a gaming machine configured to provide instances of gameplay of a primary game and selectively provide instances of gameplay of a secondary game includes: determining whether to provide a respective instance of a secondary game based at least on a respective first current amount of available secondary game credits. In response to determining to provide the first instance of the secondary game, the method further includes: enabling a secondary game buy-in option, collecting a respective first wager, and selectively providing the first instance of the secondary game. In response to determining not to provide the instance of the secondary game, the method further includes: collecting a respective second wager, providing a respective instance of the primary game, determining an outcome of the first instance of the primary game, and determining whether to provide a respective instance of the secondary game based at least on the outcome of the first instance of the primary game.

In one aspect, a gaming system to selectively provide an instance of a primary game or a secondary game includes a player interface configured to receive input from a player, a processor in communication with the player interface that executes instructions, and a memory in communication with the processor. The memory stores instructions that cause the processor to provide a secondary game buy-in option to a first respective instance of a secondary game that is triggerable based at least on at least one outcome of a primary game based at least on a determined current number of available credits; selectively provide the first respective instance of the secondary game based at least on player-input indicative of acceptance of the secondary game buy-in option; debit a respective first number of credits from the current number of available credits based at least on the player-input indicative of acceptance of the secondary game buy-in option; selectively provide a respective instance of the primary game based at least on the current number of available credits; debit a respective second number of credits from the current number of available credits based at least on the provisioning a player with the respective instance of the primary game; and from time-to-time, provide the secondary game buy-in option to a second respective instance of the secondary game based at least on respective outcomes of at least one instance of the primary game.

In one aspect, a gaming system to selectively provide an instance of a primary game or a secondary game includes a player interface configured to receive input from a player, a processor in communication with the player interface that executes instructions, and a memory in communication with the processor. The memory stores instructions that cause the processor to determine whether to provide a respective instance of a secondary game based at least on a respective first current amount of available secondary game credits. The memory stores further instructions that cause the processor to enable a secondary game buy-in option in response to determining to provide the first instance of the secondary game. The memory stores further instructions that cause the processor to collect a respective first wager in response to determining to provide the first instance of the secondary game. The memory stores further instructions that cause the processor to selectively provide the first instance of the secondary game in response to determining to provide the first instance of the secondary game. The memory stores further instructions that cause the processor to collect a respective second wager in response to determining not to provide the instance of the secondary game. The memory stores further instructions that cause the processor to provide a respective instance of the primary game in response to determining not to provide the instance of the secondary game. The memory stores further instructions that cause the processor to determine an outcome of the first instance of the primary game in response to determining not to provide the instance of the secondary game. The memory stores further instructions that cause the processor to determine whether to provide a respective instance of the secondary game based at least on the outcome of the first instance of the primary game in response to determining not to provide the instance of the secondary game.

Figure 1:
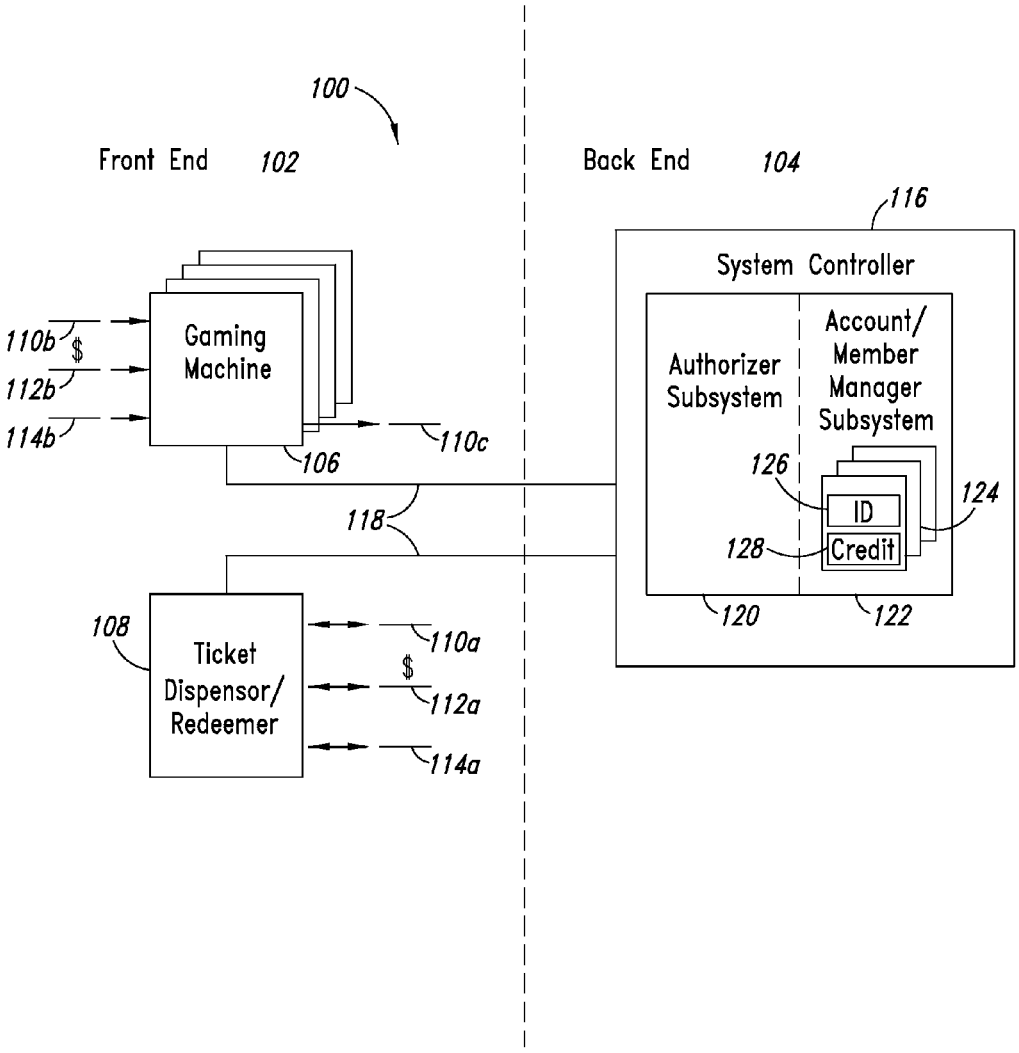
FIG. 1 is a block diagram of a game-entertainment system according to one non-limiting illustrated embodiment.

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with servers, networks, displays, computer type devices, ticket/currency validators, machine-readable symbols readers, and/or with game subsystems have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive, sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

Any process descriptions or blocks in flowcharts described below may be understood as representing modules, segments, or portions of code which include one or more executable instructions for implementing specific logical functions or acts. In alternative embodiments, various logical functions, or acts may be executed out of order from that shown or discussed, including substantially concurrently or in reverse order, and/or manually, depending on the functionality involved, as would be understood by those reasonably skilled in the art. Certain acts in the processes or process flow described in all of the logic flow diagrams referred to below must naturally precede others to function as described. However, the various embodiments are not limited to the order of the acts described if such order or sequence does not alter the functionality of one or more of the embodiments. That is, it is recognized that some acts may be performed before, after, or in parallel with other acts. Further, some embodiments may include additional acts and/or omit other acts.

FIG. 1 shows a game-entertainment system 100 according to one non-limiting illustrated embodiment. The game-entertainment system 100 may include a front end 102 and a back end 104.

The front end 102 includes gaming machines 106 and may include a ticket dispenser/redeemer 108. The ticket dispenser/redeemer 108 may be an automated device, kiosk, and/or a cashier's booth. A player (not shown) may purchase a ticket 110*a* by, among other ways, providing the ticket dispenser/redeemer 108 with a unit 112*a* of a currency having a first monetary value or by providing a financial medium 114*a* such as, but not limited to, credit card, debit card, gift card, smart card, etc.

The front end 102 of the game-entertainment system 100 may include various games of chance and/or of skill that may be played for entertainment and/or for monetary wagers. Games of chance may include slot machines, roulette, etc. Games of skill may include poker, blackjack, arcade games, etc. In some embodiments, the front end 102 may provide players with the opportunity to place monetary wagers on, among other things, the outcome of a game using tickets, referenced individually as 110*a*, 110*b*, and 110*c* and collectively as 110, and units of a currency, referenced individually as 112*a*, 112*b*, 112*c* and collectively as 112. In some instances such wagers may use pretend money, which has no actual value outside of the game, casino, arcade or other establishment. Such may, for example, be used at charitable "casino night" type events.

In some embodiments, a nominal number of entertainment center credits (ECCs) may be associated with the ticket 110*a*. In some embodiments, the game-entertainment system 100 may employ a tiered entertainment center credit system such as fully redeemable entertainment center credits (fECCs) and partially-redeemable entertainment center credits (pECCs). A fully-redeemable entertainment center credit may be associated with a monetary value, and as such, the ticket 110*a* may be redeemable at the ticket dispenser/redeemer 108. The amount of money for which the ticket 110*a* may be redeemed may depend on the number of entertainment center credits associated with the ticket 110*a* and the monetary value of an entertainment center credit, whereas partially-redeemable entertainment center credits (pECCs) may only be redeemable for further entertainment center credit, goods or services offered by the game-entertainment system 100 or affiliated entities, etc. pECCs may be particularly useful where tickets are distributed as an incentive (e.g., comp).

In some embodiments, transactions at the game-entertainment system 100 may done using entertainment center credits (ECCs), which may, in some embodiments include pECCs and fECCs. For example, at a gaming machine 106, a player may purchase a number of ECCs by providing the gaming machine 106 with one or more units of currency 112*b* and/or a financial medium 114*b*. The gaming machine 106 may convert a monetary amount into a number of ECCs based at least on an exchange rate between a respective currency and ECCs. For example, a monetary amount of one U.S. dollar may equal one ECC. Based at least on a number of available ECCs, the gaming machine 106 may selectively provide the player with an instance of a primary game. As one example, if the number of available ECCs is greater than a primary game credit threshold (PGC_Thresh), then the gaming machine 106 may provide the player with an instance of a primary game. In some embodiments, the primary game credit threshold (PGC_Thresh) may correspond to an amount of a wager placed by the player. In some embodiments, the player may wager an amount of ECCs on an outcome of an instance of the primary game that is greater than the primary game credit threshold (PGC_Thresh). The number of available ECCs is decreased in accordance with the number of ECCs wagered on an instance of the primary game. Based at least on the outcome of an instance of the primary game, the player may receive additional ECCs.

In some embodiments, based at least on an outcome of the primary game, the gaming machine 106 may provide the player with an instance of a secondary game. As an example, an outcome of the primary game that triggers the instance of the secondary game may occur on average once every 150 primary games. In addition to providing an instance of a secondary game based on an outcome of the primary game, the gaming machine may provide an instance of the secondary game based at least on a number of available credits, ECCs, which may include fully or partially redeemable credits.

In some embodiments, based at least on multiple outcomes of the primary game, the gaming machine 106 may provide the player with an instance of a secondary game. As an example, based on outcomes of respective multiple instances of the primary game, a player may accrue a number of credits that may applied toward triggering an instance of the secondary game. In addition to accruing credits that may applied toward triggering an instance of the secondary game, the gaming machine may provide an instance of the secondary game based at least on a number of available credits, ECCs, which may include fully or partially redeemable credits and which may include credits accrued credits and/or purchased credits.

In some embodiments, the game-entertainment system 100 may provide additional tiered credit in conjunction with, or separate from, the entertainment center credits described above. The game-entertainment system 100 may provide primary game credits (PGCs) and secondary game credits (SGCs). Primary game credits may be redeemable at a gaming machine for purchasing an instance of a primary game provided by the gaming machine. Secondary game credits may be redeemable at a gaming machine for purchasing an instance of a secondary game provided by the gaming machine. The primary game credits (PGCs) and/or secondary game credits (SGCs) may be fully or partially redeemable. In some embodiments, partially redeemable (primary or secondary) game credits may be awarded to a player as comps and/or bonus points from playing a game. In some embodiments, fully redeemable (primary or secondary) game credits may be awarded to a player as comps and/or bonus points from playing a game and/or purchased by a player In addition to being redeemable, an entertainment center credit may be used to purchase an instance, or instances, of gameplay at the gaming machines 106 and/or other services and goods offered at the game-entertainment system 100.

In addition to being redeemable, a primary game credit may be used to purchase an instance, or instances, of gameplay of a primary game offered at the gaming machines 106 and/or other services and goods offered at the game-entertainment system 100.

In addition to being redeemable, a secondary game credit may be used to purchase an instance, or instances, of gameplay of a secondary game offered at the gaming machines 106 and/or other services and goods offered at the game-entertainment system 100.

In the following description, credits of the game-entertainment system 100 are described as including ECCs (which may include fEECs and pEECs), PGCs (which may include fPGCs and pPGCs), and SGCs (which may include fSGCs and pSGCs), however, such description is non-limiting, and in some embodiments, the game-entertainment 100 may employ a single credit type, e.g., ECC, and in other embodiments, the game-entertainment 100 may employ additional credit types. Some or all the credit types of the game-entertainment system 100 may be converted into a monetary amount of a respective currency based at least on a respective exchange rate between the respective currency and the respective credit. Different types of credits may have different exchange rates. For example, one ECC may equal one U.S. dollar, one PGC may equal five U.S. dollars, and one SGC may equal ten U.S. dollars. Similarly, there may be various exchange rates between the types of credits. For example, five ECCs may equal one PGC, and ten ECCs may equal one SGC. Furthermore, in some embodiments, the various types of credits, e.g., ECCs, PGCs, and SGCs, may include fully redeemable credits and partially redeemable credits, which may have different exchange rates. For example, five fECCs may equal one fPGC, and ten fECCs may equal one fSGC, but seven and one-half pECCs may equal one pPGC, and fifteen pECCs may equal one pSGC.

For the purposes of this disclosure, a primary game is a game that the gaming machine 106 provides based only on a number of available credits (e.g., ECCs and/or PGCS) including credits which may be fully or partially redeemable.

For the purposes of this disclosure, a secondary game is a game that the gaming machine 106 provides based at least on at least one outcome of at least one primary game and is a game that the gaming machine 106 provides based at least on a number of available credits (e.g., ECCs and/or PGCs and/or SGCs) including credits which may be fully or partially redeemable. For example, the secondary game may be triggerable based on an outcome of an instance of the primary game and/or may be triggerable based on a number of available credits. As another example, the secondary game may be triggerable based on multiple outcomes of respective instances of the primary game, e.g., a player may accrue credits (e.g., ECCs and/or PGCs and/or SGCs, which also include credits that may be fully or partially redeemable) by playing the primary game, and when the player has a sufficient number of available credits (e.g., ECCs and/or PGCs and/or SGCs, which also include credits that may be fully or partially redeemable), the gaming machine 106 may provide an instance of the secondary game. Thus, primary games are not triggerable based on at least one outcome of a different game such as a secondary game, but secondary games are triggerable based on at least one outcome of a different game such as a primary game.

The first time a player uses the game-entertainment system 100, or any time thereafter, the player may purchase the ticket 110*a* from the ticket dispenser/redeemer 108. After the ticket dispenser/redeemer 108 receives and/or verifies the unit 112*a* of a currency and/or the financial medium 114*a*, the ticket dispenser/redeemer 108 may provide a purchase request to the back end 104. The purchase request may include a purchase amount that generally corresponds to the monetary value of the unit 112*a* of the currency, an amount to be charged to the financial medium 114*a*, an aggregate of an amount to be charged to the financial medium 114*a* and the monetary value of the unit 112*a* of the currency, and/or some other amount of money. The purchase request may further include time-stamps and an indication of an identity of the terminal, for example, a terminal identifier.

The gaming machines 106 may be of various types, such as wager gaming machines and non-wager gaming machines. Non-wager gaming machines include various arcade type games such as pinball, in which a player may attempt to accumulate a number of points which may, or may not, have actual monetary redeemable value. Wager gaming machines may include various games such as poker, blackjack, etc. The gaming machines 106 may include electronic-based devices where a player plays a virtual game. For example, in a game of virtual poker, virtual cards are dealt and displayed to a player, and the player may play against the gaming machine 106. Some of the game stations 106 may be a hybrid electromechanical game such as a gaming machine with electronic payment and accounting components and mechanical game components.

A player may commence a session of gameplay by purchasing an instance of gameplay from the gaming machine 106 using a ticket 110*b* and/or a unit 112*b* of the currency and/or a financial medium 114*b*. In some embodiments, the player may accrue credits (ECCs, PGCs, and SGCs) from an instance of gameplay. Some or all of the credits may be used to purchase another instance of gameplay during the session of gameplay or some or all of the credits may be saved for later redemption.

The gaming machines 106 provide instances of a primary game and selectively provide instances of a secondary game. A player may purchase an instance of a primary game using a ticket 110*b* and/or a unit 112*b* of the currency and/or a financial medium 114*b*. The respective gaming machines 106 may be configured provide an instance of a secondary game based at least on an outcome of a primary game and/or based at least on the respective outcomes of multiple primary games.

In some embodiments, a player may accrue SGCs based at least on playing instances of the primary game. In some embodiments, after the player has accrued a sufficient number of SGCs (e.g., a number greater than a secondary game credit threshold), the player may be offered the opportunity to play an instance of a secondary game.

The gaming machines 106 are configured to provide respective players with secondary game buy-in options. A secondary game buy-in option provides a player who does not have a sufficient number of SGCs to play an instance of a secondary game with an opportunity to purchase an amount of SGCs necessary to have the sufficient number of SGCs.

When the player has finished the session of gameplay, the gaming machine 106 may provide the player with a ticket 110*c*. The ticket 110*c* may be associated a number of credits, e.g., ECCs, PGCs, and SGCs. The number of credits associated with the ticket 110*c* may be depend at least on a number of credits initially associated with the ticket 110*b* (or the monetary value of the unit 112*b* of the currency or the amount of funds charged to or debited from financial medium 114*b*) and the total number of available credits saved during the session of gameplay.

In some embodiments, the gaming machine 106 may return the ticket 110*b* to the player when the player terminates a session of gameplay. Information associated with the ticket 110*b* may be updated based at least in part on the number of instances of gameplay purchased during the session of gameplay and/or the number of entertainment center credits received by the player during the session of gameplay.

In some embodiments, patrons of the game-entertainment system 100 may enroll in various membership programs. The patrons may receive a respective a medium such as a member identification medium (e.g., card with magnetic stripe, RFID chip, machine-readable medium, touch-memory), which may be associated with a specific player/patron. The gaming machine 106 may be configured to receive the respective member identification medium of members and read information such as a respective member indicator indicative of an identifier for a specific member. The gaming machine 106 may provide the back end 104 with information indicative of a read member indicator.

A respective one of the gaming machines 106 may be configured to provide players of the respective gaming machine with instances of a primary game and to selectively provide instances of a secondary game. In some embodiments, a player may present his or her member identification medium to the gaming machine 106. The gaming machine 106 may provide the back end 104 with information indicative of a member identifier for the player. The back end 104 may provide the gaming machine 106 with information related to amounts of various credit types, e.g., ECCs, PGCs, and SGCs, that may be associated with the player. Based at least on the amounts of the various credit types, the gaming machine 106 may selectively provide the player with an instance of a primary game and/or a secondary game offered by the gaming machine 106. During a session of gameplay, the player may accrue credits. The gaming machine 106 may provide the back end 104 with information indicative of accrued credits.

The back end 104 may include a system controller 116 which may be communicatively coupled to the gaming machines 106 and to the ticket dispenser/redeemer 108 by communication links 118. The communication links 118 may be a network such as a wire, wireless, or combination thereof, network. The system controller 116 may include an authorizer subsystem 120 and an account/member manager subsystem 122 and may be embodied in a computing system, distributed computing system, servers, etc. The authorizer subsystem 120 is configured to respond to game session requests and to selectively grant or deny permission for a session of gameplay. The session request may include information indicative of a purchase amount and/or information indicative of unique ticket identification information, timestamps and terminal identity.

The account/member manager subsystem 122 may include records 124, which include account records and membership records. Each one of the records 124 may include a unique identifier 126 and an amount of credit (and/or amounts of types of credits). If the respective record 124 is an account record, the unique identifier 126 may be associated with a ticket and the credit amount 128 may generally correspond to the purchase amount and/or a number of credits. The unique identifier 126 of a respective record 124 may associate the respective record 124 with one of the tickets 110*a*, 110*b*, 110*c*, and the credit amount 128 of the respective record 124 may be indicative of the number of credits associated with the same ticket 110*a*, 110*b*, 110*c*.

If the respective record 124 is a membership record, the unique identifier 126 may be associated with a specific player having a membership identification medium. The credit amount 128 may generally correspond to a number of credits associated with the specific player.

In some embodiments, when a player uses the ticket 110*b* to purchase an instance of gameplay at the gaming machine 106, the gaming machine 106 may provide the system controller 116 with information indicative of unique ticket identification information. Based at least in part on the information indicative of unique ticket identification information, the account/member manager 122 may determine with which one of the records 124 the ticket 110*b* is associated. The determination may also be based at least in part on the respective identifier 126 for the accounts records 124. Having determined the record 124 with which the ticket 110*b* may be associated, the account/member manager 122 may determine a number of entertainment center credits associated with the ticket 110*b* based at least in part on the credit amount 128 of the respective record 124. The system controller 116 may then provide the gaming machine 106 with information indicative of the number of entertainment center credits associated with the ticket 110*b*. The gaming machine 106 may determine whether to provide an instance of gameplay based at least in part on the information indicative of the number of entertainment center credits associated with the ticket 110*b*.

In some embodiments, the tickets 110 may be single-use only tickets. For example, a player may purchase the ticket 110*a* from the ticket dispenser/redeemer 108. A record 124 may be created and associated with the ticket 110*b*. The player may commence a session of gameplay at one of the gaming machines 106 by purchasing an instance of gameplay with the ticket 110*b*. During the session of gameplay, the gaming machine 106 audits entertainment center credits for the player, e.g., available entertainment center credits equals a number of entertainment center credits initially associated with the ticket 110*a* plus a number of available entertainment center credits accrued during the session of gameplay minus a number of entertainment center credits used to purchase instances of gameplay. At the end of the session of gameplay, the gaming machine 106 may provide the system controller 116 with information indicative of the number of available entertainment center credits and provide the player with a new ticket 110*c*. The new ticket 110*c* may be associated with a newly created record 124. The player may take the new ticket 110*c* to another gaming machine 106 to commence another session of gameplay or may redeem the ticket 110 at the ticket dispenser/redeemer 108.

In some embodiments, the tickets 110 may be multi-use tickets. For example, a player may commence a session of gameplay at one of the gaming machines 106 by purchasing an instance of gameplay with the ticket 110*b*. During the session of gameplay, the gaming machine 106 audits entertainment center credits for the player, e.g., available entertainment center credits equals a number of entertainment center credits initially associated with the ticket 110*b* plus a number of entertainment center credits accrued during the session of gameplay minus a number of entertainment center credits used to purchase instances of gameplay. At the end of the session of gameplay, the gaming machine 106 may provide the system controller 116 with information indicative of the number of available entertainment center credits and provide the player with the same ticket 110*b*. The system controller 116 may update account information based at least on the information indicative of the number of available entertainment center credits. The player may take the ticket 110*b* to another gaming machine 106 to commence another session of gameplay or may redeem the ticket 110 at the ticket dispenser/redeemer 108.

In some embodiments, the account/member manager subsystem 122 may create a record 124 when a player purchases the ticket 110*a* at the ticket dispenser/redeemer 108. The credit amount 128 of the record 124 may be based at least in part on the purchase amount of the ticket 110*a*. The account/member manager subsystem 122 may provide the ticket dispenser/redeemer 108 with information indicative of a ticket identifier that may be associated with the newly created record 124. Alternatively, in some embodiments, the account/member manager subsystem 122 may receive from the ticket dispenser/redeemer 108 information indicative of a ticket identifier or information indicative of ticket identification information that may be encoded by a ticket identifier, and the received information may be associated with the newly created record 124.

In some embodiments, the ticket dispenser/redeemer 108 may generate ticket identification information and print a ticket identifier that encodes the ticket identification information on a surface of a ticket. In some embodiments, the ticket dispenser/redeemer 108 may receive information indicative of ticket identification information and print a ticket identifier that encodes the ticket identification information on a surface of a ticket. In some embodiments, the ticket dispenser/redeemer 108 may provide the system controller 116 with information indicative of ticket identification information.

In some embodiments, the account/member manager subsystem 122 may create a record 124 when a player purchases an instance of gameplay at the gaming machine 106 with an item of value that is not a ticket 110. The credit amount 128 of the newly created record 124 may be based at least in part on the monetary value of the unit 112*b* of the currency and/or the amount of money to be charged to or debited from financial medium 114*b*. The account/member manager subsystem 120 may provide the gaming machine 106 with information indicative of a ticket identifier that is associated with the newly created record 124. Alternatively, in some embodiments, the account/member manager subsystem 120 may receive information indicative of a ticket identifier that is associated with the newly created record 124 from the gaming machine 106.

In some embodiments, the account/member manager subsystem 122 may create a record 124 after a player has ended a session of gameplay at the gaming machine 106. For example, the credit amount 128 of the newly created record 124 associated with ticket 110*c* may reflect a number of entertainment center credits based at least in part on the number of available entertainment center credits at the end of the session of gameplay by the player.

In some embodiments, the account/member manager subsystem 122 may update a record 124 after a player has ended a session of gameplay at the gaming machine 106. For example, the credit amount 128 of the record 124 associated with ticket 110*b* may be updated to reflect a change in a monetary value or a change in a number of entertainment center credits based at least in part on the number of available entertainment center credits at the end of the session of gameplay.

Figure 2:
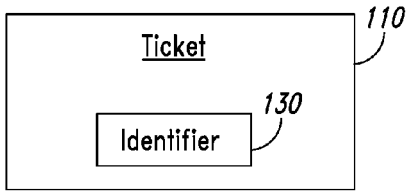
FIG. 2 is a block diagram of a ticket for purchasing an instance of gameplay at the game-entertainment system according to one non-limiting illustrated embodiment.

FIG. 2 shows a ticket 110 according to one non-limiting illustrated embodiment. The ticket 110 may be made of paper or similar material and/or other material. The ticket 110 includes a ticket identifier 130. In some embodiments, the ticket identifier 130 may be one or more machine-readable symbols (e.g., bar code symbols, stack code symbols, area or matrix code symbols) that encode a ticket code that may be indicative of unique ticket identification information. In such embodiments, the gaming machine 106 and the ticket dispenser/redeemer 108 may include one or more machine-readable symbol readers, such as scanners or imagers that read bar codes, stacked codes, and/or area or matrix codes, and the gaming machine 106 and the ticket dispenser/redeemer 108 may include instructions for decoding such machine-readable symbols. The ticket identifier 130 may be associated with the identifier 126 of a respective record 124. The ticket may also include human-readable information, for example, an indication of a current value or worth of the ticket in currency or credits.

Figure 3:
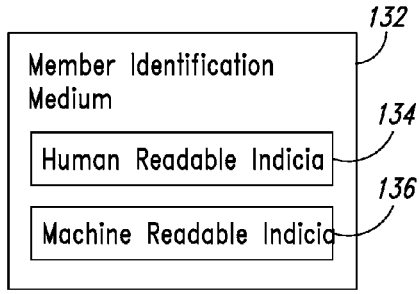
FIG. 3 is a block diagram of a member identification medium according to one non-limiting illustrated embodiment.

FIG. 3 shows a member identification medium 132 according to one non-limiting illustrated embodiment. The member identification medium 132 may include human-readable indicia 134 that may be indicative of, among other things, a unique member identifier. In some embodiments, the member identification medium 132 may include machine-readable medium 136 encoding member identification information that may be indicative of a unique member identifier. The machine-readable medium 136 encoding member identification information may take a variety of forms such as, but not limited to, machine-readable symbols (e.g., bar code symbols, stack code symbols, area or matrix code symbols). In some embodiments, the machine-readable medium 136 encoding member identification information may include, but is not limited to, one or more wireless data provider communication devices such as radio frequency identification devices and/or one or more data storage devices such as magnetic stripes. As another example, the machine-readable medium 116 encoding member identification information may include, but is not limited to, one or more wireless data provider communication devices such as radio frequency identification devices and/or one or more data storage devices such as magnetic stripes.

Figure 4:
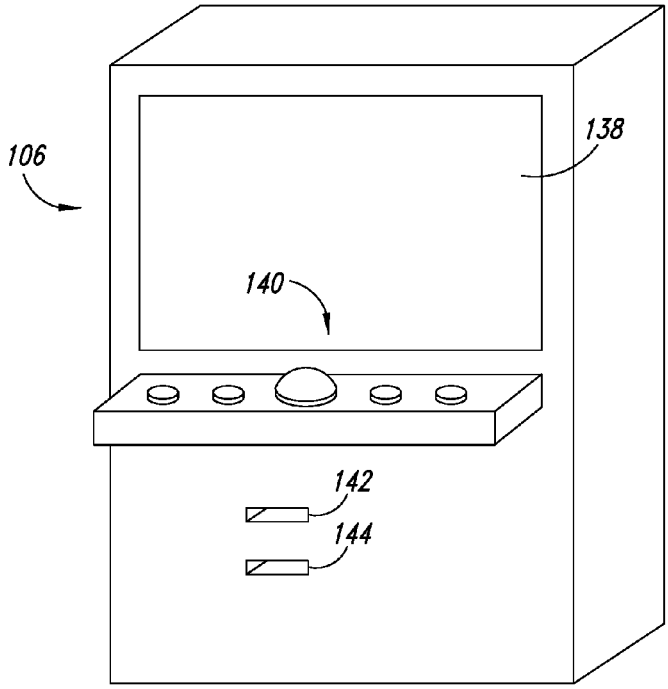
FIG. 4 is an isometric view of a gaming machine of the game-entertainment system according to one non-limiting illustrated embodiment.

FIG. 4 shows a gaming machine 106 according to one non-limiting embodiment. The gaming machine 106 includes a display device 138 and a user interface 140. The user interface 140 may include various buttons, keys, track wheel, track ball, joy stick, key pad, number pad, touch pad, touch screen, user selectable icons, etc. A player may use the user interface 140 to, among other things, select a game or virtual game, control and play a game or virtual game, and to select an amount to be charged to or debited from financial medium 114*b*.

The display device 138 may take a variety of forms, for example cathode ray tube (CRT) displays, or flat panel displays such as liquid crystal (LCD) displays, liquid crystal on silicon (LCOS) displays, plasma displays, digital light processing (DLP) displays, other projection type of displays, and touch sensitive displays.

The gaming machine 106 also includes an item of value (IOV) receiver 142 and a reader 144. The IOV receiver 142 may receive items that are purportedly of value. The IOV receiver 142 is configured to receive units 112*b* of a respective currency and tickets 110*b*. In some embodiments, the IOV receiver 142 may receive units 112*b* of a currency of various denominations and of various currencies, e.g., a Canadian ten-dollar bill and a U.S. ten-dollar bill.

The reader 144 may take a variety of forms including, but not limited to, one or more magnetic stripe readers operable to read information indicative of member identification information and/or account identification information encoded into one or more magnetic stripes. Alternatively, or additionally, the reader 110 may take the form of one or more optical machine-readable symbol readers operable to read information indicative of member identification information and/or account identification information encoded into one or more machine-readable symbols (e.g., barcode symbols, stacked code symbols, area or matrix code symbols, etc.). In addition, the reader 110 may take the form of one or more RFID readers or interrogators operable to read information indicative of member identification information and/or account identification information encoded into one or more RFID carriers (e.g., tags or cards).

In some embodiments, the reader 144 may receive financial media 114*b* such as credit cards, debit cards, gift cards, smart cards, etc. A user of the gaming machine 106 may use the IOV receiver 142 and/or the reader 144 along with ticket 110*b* and/or the unit 112*a* of the currency and/or financial medium 114*b* to commence a session of gameplay.

In some embodiments, the reader 144 may receive the member identification medium 132. The reader 110 may read the human readable indicia 134 and/or the machine readable medium 136.

Among other things, the gaming machine 106 may provide the back end 104 with an indication of the member identification information read from the machine-readable medium 136 of a player's member identification medium 132.

Figure 5:
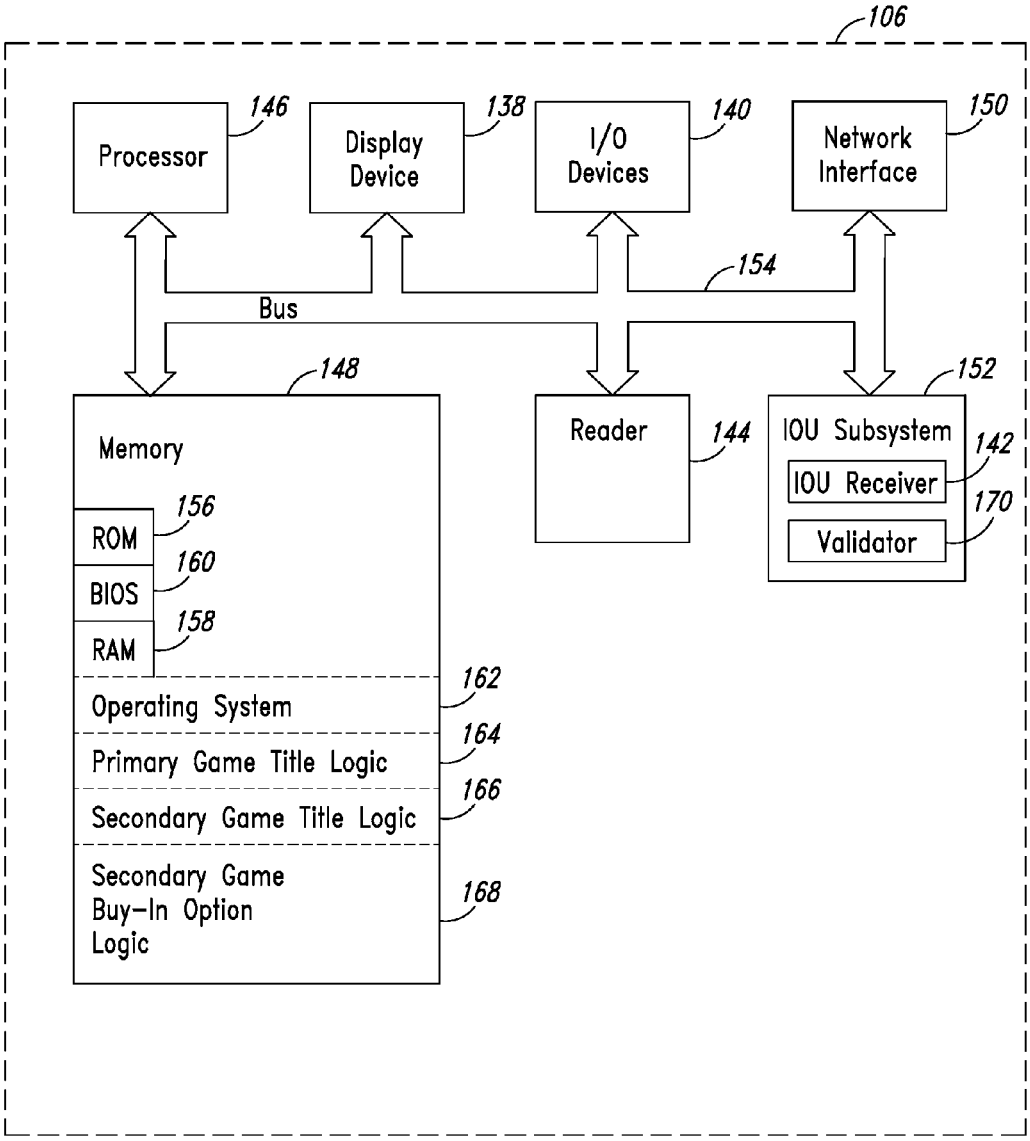
FIG. 5 is schematic diagram of the gaming machine of FIG. 4, according to one non-limiting illustrated embodiment.

FIG. 5 shows a gaming machine 106 according to another non-limiting illustrated embodiment. The gaming machine 106 includes the display device 138, the user interface 140, and the reader 144, which were previously discussed and which, for the sake of brevity, will not be discussed in detail below.

The gaming machine 106 includes a processor 146, a memory 148, network interface 150, and an IOV subsystem 152, which are communicatively coupled by one or more buses 154. The processor 146 may be a device for executing software, particularly that stored in the memory 148. The processor 146 may be a custom-made or commercially available processor, a central processing unit (CPU), a semiconductor-based microprocessor (in the form of a microchip or chip set), or generally any device for executing software instructions.

The memory 148 is communicatively coupled to the processor 146 via bus 154. The bus 154 can employ any known bus structures or architectures, including a memory bus with memory controller, a peripheral bus, and a local bus.

The memory 148 includes read-only memory ("ROM") 156 and random access memory ("RAM") 158. A basic input/output system ("BIOS") 160, which can form part of the ROM 154, contains basic routines that help transfer information between elements within the gaming machine 106, such as during start-up. The RAM 158 may include dynamic random-access memory (DRAM), static random-access memory (SRAM), synchronous dynamic random-access memory (SDRAM), flash RAM, etc.

The memory 148 may store one or more logic modules or logic routines, each of which may comprise an ordered listing of executable instructions for implementing logical functions. In particular, the memory 148 includes an operating system 162 and secondary game buy-in option logic 168. The execution of the operating system 162 by the processor 146 essentially controls the execution of other logic, such as secondary game buy-in option logic 168, and provides scheduling, input-output control, file and data management, memory management, and communication control and related services.

The secondary game buy-in option logic 168 may include various logic modules or logic routines, each of which may comprise an ordered listing of executable instructions for implementing logical functions. In particular, the secondary game buy-in option logic 168 may include logic for, among other things, gathering player data such as amounts of various types of credits (ECCs, PGCs, SGCs) associated with the player via a membership account and/or associated with a ticket presented by the player, determining a number of available credits for various types of credits, and selectively enabling and/or disabling a secondary game buy-in option.

In some embodiments, the secondary game buy-in option logic 168 or a portion of the secondary game buy-in option logic 168 may be implemented in firmware that is stored in a memory and that is executed by a suitable instruction execution system. If implemented in hardware, as in an alternative embodiment, the secondary game buy-in option logic 168 and/or various logic modules or logic routines of the gaming machine reconfiguration logic 162 may be implemented with any or a combination of the following technologies: a discrete logic circuit(s) having logic gates for implementing logic functions on data signals, an application specific integrated circuit (ASIC) having appropriate combinational logic gates, a programmable gate array(s) (PGA), a field programmable gate array (FPGA), etc.

The memory 148 also includes primary game title logic 164 and secondary game title logic 166. The primary game title logic 164 and secondary game title logic 166 may respectively include various modules or routines or logic, each of which may comprise an ordered listing of executable instructions for implementing logical functions. In particular, the primary game title logic 164 and the secondary game title logic 166 may include logic for, among other things, providing instances of a primary game title and a secondary game title, respectively.

The network interface 150 may include network cards and/or wireless communication devices that provide a communication link 118 with the system controller 116.

The IOV subsystem 152 includes the IOV receiver 142 and a validator 170, and in some embodiments, the IOV subsystem 152 may include the reader 144. The IOV receiver 142 receives items that are purportedly items of value such as tickets 110 and units 112 of a respective currency. The IOV receiver 142 provides the validator 70 with the received items.

The validator 170 may be configured to validate purported items of value. The validator 170 may determine whether a purported item of value is a valid ticket and/or a valid unit of a currency. For example, the validator 170 may determine whether a purported item of value is a valid unit of a currency, such as, but not limited to, a United States (U.S.) dollar bill, a U.S. five-dollar bill, a U.S. ten-dollar bill, a U.S. twenty-dollar bill, etc. Such may include optically, magnetically, inductively, capacitively, or otherwise sensing various characteristics of the purported item of value and comparing the sensed characteristics to defined values representative of valid characteristics. In some embodiments, the validator 170 may be configured to validate units of currency for multiple currencies.

The validator 170 may be also configured to validate received tickets 110. Among other things, the validator 170 may read the ticket identifier 130 on a ticket 110. If the validator 170 determines that a purported item of value is valid, the validator 170 signals the processor 146. If the validator 148 cannot validate a purported item of value, the purported item of value may be rejected and may be ejected from the gaming machine 106.

Figure 6:
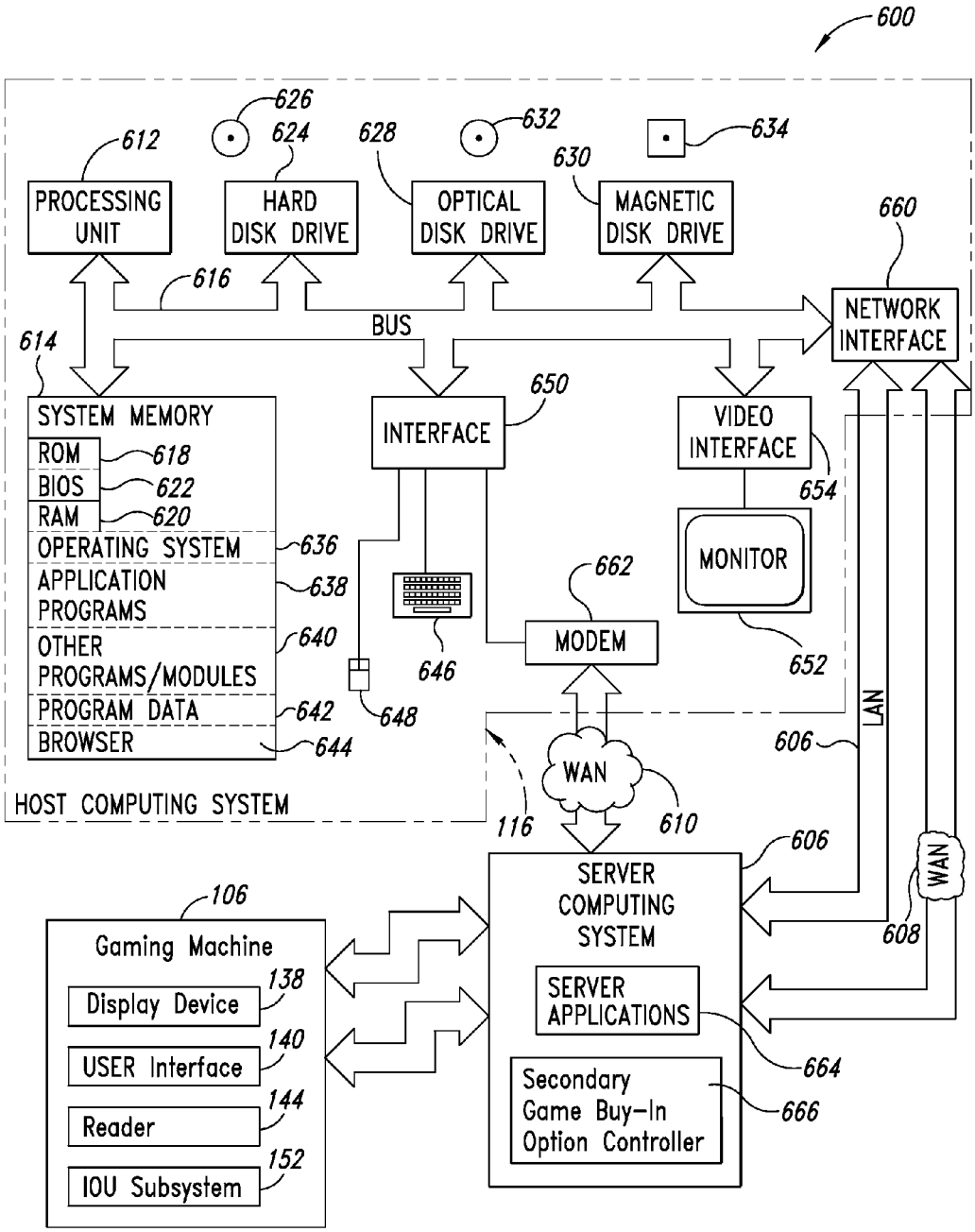
FIG. 6 is schematic diagram of a gaming-entertainment system environment such as a casino, according to one non-limiting embodiment.

FIG. 6 and the following discussion provide a brief, general description of a suitable gaming-entertainment system environment 600 in which the various illustrated embodiments may be implemented. Although not required, the embodiments will be described in the general context of computer-executable instructions, such as program application modules, objects, or macros being executed by a computer. Those skilled in the relevant art will appreciate that the illustrated embodiments as well as other embodiments may be practiced with other computer system configurations, including handheld devices, multiprocessor systems, microprocessor-based or programmable consumer electronics, personal computers ("PCs"), network PCs, mini computers, mainframe computers, and the like. The embodiments may be practiced in distributed computing environments where tasks or modules are performed by remote processing devices, which are linked through a communications network. In a distributed computing environment, program modules may be located in both local and remote memory storage devices.

FIG. 6 shows the gaming-entertainment system environment 600 comprising one or more gaming machines 106, one or more system controllers 116, and/or server computing systems 606 coupled by one or more communications channels, for example one or more local area networks (LANs) 608 or wide area networks (WANs) 610. The gaming-entertainment system environment 600 may employ other computers, such as conventional personal computers, where the size or scale of the system allows.

The system controller 116 may take the form of a conventional mainframe or mini-computer that includes a processing unit 612, a system memory 614 and a system bus 616 that couples various system components including the system memory 614 to the processing unit 612. The system controller 116 will at times be referred to in the singular herein, but this is not intended to limit the embodiments to a single computing system since in typical embodiments there will be more than one computing system or other device involved. Non-limiting examples of commercially available systems include, but are not limited to, an 80x86 or Pentium series microprocessor from Intel Corporation, U.S.A., a PowerPC microprocessor from IBM, a Sparc microprocessor from Sun Microsystems, Inc., a PA-RISC series microprocessor from Hewlett-Packard Company, or a 68xxx series microprocessor from Motorola Corporation.

The processing unit 612 may be any logic processing unit, such as one or more central processing units (CPUs), digital signal processors (DSPs), application-specific integrated circuits (ASICs), field programmable gate arrays (FPGAs), etc. Unless described otherwise, the construction and operation of the various blocks shown in FIG. 6 are of conventional design. As a result, such blocks need not be described in further detail herein, as they will be understood by those skilled in the relevant art.

The system bus 616 can employ any known bus structures or architectures, including a memory bus with memory controller, a peripheral bus, and a local bus. The system memory 614 includes read-only memory ("ROM") 618 and random access memory ("RAM") 620. A basic input/output system ("BIOS") 622, which can form part of the ROM 618, contains basic routines that help transfer information between elements within the system controller 116, such as during start-up.

The system controller 116 also includes a hard disk drive 624 for reading from and writing to a hard disk 626, and an optical disk drive 628 and a magnetic disk drive 630 for reading from and writing to removable optical disks 632 and magnetic disks 634, respectively. The optical disk 632 can be a CD-ROM, while the magnetic disk 634 can be a magnetic floppy disk or diskette. The hard disk drive 624, optical disk drive 628 and magnetic disk drive 630 communicate with the processing unit 612 via the system bus 616. The hard disk drive 624, optical disk drive 628 and magnetic disk drive 630 may include interfaces or controllers (not shown) coupled between such drives and the system bus 616, as is known by those skilled in the relevant art. The drives 624, 628 and 630, and their associated computer-readable media 626, 632, 634, provide nonvolatile storage of computer readable instructions, data structures, program modules and other data for the system controller 116. Although the depicted system controller 116 employs hard disk 624, optical disk 628 and magnetic disk 630, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 614, such as an operating system 636, one or more application programs 638, other programs or modules 640 and program data 642. The system memory 614 may also include communications programs, for example, player access logic 644. The player access logic 644 may allow a player to access a virtual game-entertainment environment via a communication network. For example, in some embodiments, a player may use a Web client such as a commercially available browser. Non-limiting examples of commercially available browsers include Mozilla Firefox developed by Mozilla Foundation based in Mountain View, Calif., USA, Safari developed by Apple Inc. based in Cupertino, Calif., USA., and Internet Explore by Microsoft Corp. based in Redmond, Wash., USA.

While shown in FIG. 6 as being stored in the system memory 614, the operating system 636, application programs 638, other programs/modules 640, program data 642 and player access logic 644 can be stored on the hard disk 626 of the hard disk drive 624, the optical disk 632 of the optical disk drive 628 and/or the magnetic disk 634 of the magnetic disk drive 630.

An operator, such as casino personnel, can enter commands and information into the system controller 116 through input devices such as a touch screen or keyboard 646 and/or a pointing device such as a mouse 648. Other input devices can include a microphone, joystick, game pad, tablet, scanner, etc. These and other input devices are connected to the processing unit 612 through an interface 650 such as a serial port interface that couples to the system bus 616, although other interfaces such as a parallel port, a game port, a wireless interface, or a universal serial bus ("USB") can be used. A monitor 652 or other display device is coupled to the system bus 616 via a video interface 654, such as a video adapter. The system controller 116 can include other output devices, such as speakers, printers, etc.

The system controller 116 can operate in a networked environment using logical connections to one or more remote computers and/or devices, for example, the server computing system 606. The server computing system 606 can be another personal computer, a server, another type of computer, or a collection of more than one computer communicatively linked together and typically includes many or all of the elements described above for the system controller 116. The server computing system 606 is logically connected to one or more of the game-entertainment system controllers 120 under any known method of permitting computers to communicate, for example, through one or more LANs 608 and/or WANs 610 such as the Internet. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the system controller 116 is connected to the LAN 608 through an adapter or network interface 660 (communicatively linked to the system bus 616). When used in a WAN networking environment, the system controller 116 may include a modem 662 or other device, such as the network interface 660, for establishing communications over the WAN 610. The modem 662 is shown in FIG. 6 as communicatively linked between the interface 650 and the WAN 610.

In a networked environment, program modules, application programs, data, or portions thereof, can be stored in the server computing system 606. In the depicted embodiment, the system controller 116 is communicatively linked to the server computing system 606 through the LANs 608 and/or WAN 610, for example with TCP/IP middle layer network protocols. However, other similar network protocol layers are used in other embodiments, such as User Datagram Protocol ("UDP"). Those skilled in the relevant art will readily recognize that the network connections shown in FIG. 6 are only some examples of establishing communication links between computers, and other links may be used, including wireless links.

The server computing system 606 includes server applications 664 for the routing of instructions, programs, data and agents between the gaming machine 106, player-activity sensor subsystem 118, and/or system controller 116. For example the server applications 664 may include conventional server applications such as WINDOWS NT 6.0 Server, and/or WINDOWS 2000 Server, available from Microsoft Corporation in Redmond, Wash. Additionally, or alternatively, the server applications 664 can include any of a number of commercially available Web servers, such as INTERNET INFORMATION SERVICE from Microsoft Corporation and/or IPLANET from Netscape/America On Line (AOL).

The server computing system 606 may also include secondary game buy-in option controller 666. Among other things, the secondary game buy-in option controller 666 may comprise an ordered listing of executable instructions for implementing logical functions. In particular, the secondary game buy-in option controller 666 may include logic for, among other things, enabling and/or disabling an option for a player of a respective gaming machine to select whether or not to play a secondary game. Among other things, the secondary game buy-in option controller 666 may include logic for determining an amount of available credits and/or available amounts of various types of credits. The secondary game buy-in option controller 666 may include logic for enabling and/or disabling an optional player buy-in for a secondary game based at least on available credit.

The gaming machine 106 and/or the user interface 140 may include one or more controllers and/or memories and may store and execute one or more applications for providing information to, and collecting information from, players of the gaming machine 106. For example, a player may accept or reject the opportunity to play a secondary game. The user interface 140 may provide the player with selectable icons on the display device 138 for accepting and/or rejecting an offer to buy-in to a secondary game.

Figure 7:
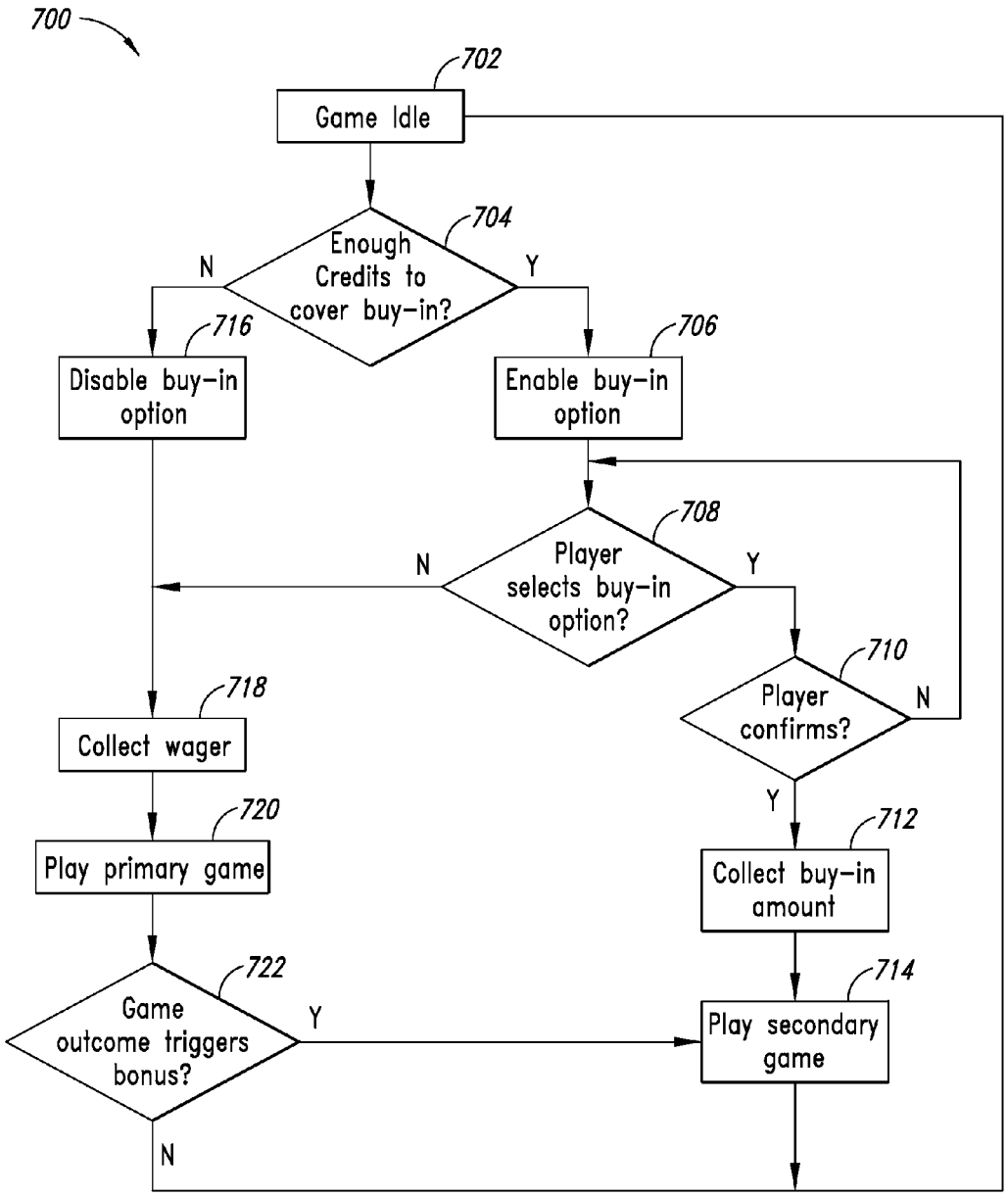
FIG. 7 is a flow diagram of a method for enhancing gaming at a gaming machine configured to provide instances of gameplay of a primary game and selectively provide instances of gameplay of a secondary game according to one illustrated embodiment.

FIG. 7 shows a flow diagram 700 of a method for enhancing gaming at a gaming machine configured to provide instances of gameplay of a primary game and selectively provide instances of gameplay of a secondary game according to one illustrated embodiment.

At 702, a gaming machine is idle. The gaming machine may be idle when the gaming machine is not being played by a player. The gaming machine may also be idle before or after providing an instance of a game title provided by the gaming machine.

At 704, a determination is made as to whether a player of the gaming machine has enough available credits for a secondary game buy-in option. The determination may be made by the gaming machine. Alternatively, the determination may be made by a remote controller such as by the server computer system 606. In some embodiments, the gaming machine may employ a single credit type for primary and secondary games. In that case, the determination as to whether the player has enough credits may be based at least on a number of game credits (GCs). If the determination is negative, the method continues at 716. If the determination is affirmative, the process continues at 706.

However, in some embodiments, the gaming machine may employ different credit types for primary and secondary games. The determination as to whether the player has enough credits may be based at least on a number of secondary game credits (SGCs). The number of secondary game credits may include some secondary game credits that were awarded to the player and/or some secondary game credits that were purchased by the player. Some or all of the number secondary game credits may be fully redeemable secondary game credits (fSGCs). Some or all of the secondary game credits may be partially redeemable secondary game credits (pSGCs). Alternatively, the number of secondary game credits may be a combination of fully redeemable secondary game credits (fSGCs) and of partially redeemable secondary game credits (pSGCs).

In some embodiments, the determination may be based at least on a number of primary game credits (PGCs). The number of PGCs may include fully redeemable primary game credits (fPGCs) and/or partially redeemable primary game credits (pPGCs) and/or a combination of fPGCs and pPGCs.

In some embodiments, the determination may be based at least on a number of entertainment center credits (ECCs). The number of ECCs may include fully redeemable entertainment center credits (fECCs) and/or partially redeemable entertainment center credits (pECCs) and/or a combination of fECCs and pECCs.

In some embodiments, a determination may be based at least on a combination of a number of available secondary game credits (SGCs). The number of available SGCs may include fSGCs and/or pSGCs, and a number of entertainment center credits (ECCs), which may include fECCs and/or pECCs. A player's EECs may be converted into SGCs based on an exchange rate.

In some embodiments, a determination may be based at least on a combination of a number of available secondary game credits (SGCs), which may include fSGCs and/or pSGCs, a number of entertainment center credits (ECCs), which may include fECCs and/or pECCs, and a number of primary game credits (PGCs), which may include fPGCs and/or pPGCs. A player's EECs and PGCs may be converted into SGCs based on respective exchange rates In some embodiments, a determination may be based at least on a combination of a number of secondary game credits (SGCs), which may include fSGCs and/or pSGCs, and a number of primary game credits (PGCs), which may include fPGCs and/or pPGCs and which may be converted into SGCs based on an exchange rate.

At 706, a secondary game buy-in option is enabled. The gaming machine may provide notification to the player of the player's option to buy-in to a secondary game provided by the gaming machine. The notification may be visually provided on a display of the gaming machine, or audibly provided via speakers, and/or audiovisually. The notification may provide the player with information such as a number of game credits. The notification may include a game credit buy-in amount. The game credit buy-in amount may be indicative of a number of game credits necessary for exercising the secondary game buy-in option.

In some embodiments, the gaming machine may employ multiple types of credit. In that case, the notification may provide the player with information such as a number of secondary game credits and/or a number of entertainment credits and/or a number of primary game credits. The notification may include an entertainment credit center buy-in amount and/or a primary game credit buy-in amount. The entertainment center credit buy-in amount may be indicative of a number of entertainment center credits necessary for exercising the secondary game buy-in option. The primary game credit buy-in amount may be indicative of a number of primary game credits necessary for exercising the secondary game buy-in option.

At 708, a determination is made as to whether the player selected the secondary game buy-in option. The player may use the player interface of the gaming machine to make the selection. If the player rejected the secondary game buy-in option, the method continues at 718. However, if the player accepted the secondary game buy-in option, the method may continue at 710.

At 710, a determination is made as to whether the player confirms the selection of the secondary game buy-in option. If the player changes his/her mind and/or accidentally and/or unintentionally accepts the secondary game buy-in option, then the player cancels the previous selection, and the process reverts to 708. If the player confirms the selection of the secondary game buy-in option, the method continues at 712. In some embodiments, decision block 710 may be optional.

At 712, a buy-in amount of credits is collected. Credits associated with the player such as GCs, ECCs, PGCs, and/or SGCs may be debited to cover the buy-in amount of credits.

At 714, an instance of a secondary game title is provided to the player. After the player has completed playing the instance of the secondary game title, the process returns to 702.

Referring back to 704, if the determination was negative, the process continues at 716. At 716, the secondary game buy-in option is disabled. In some embodiments, block 716 may be optional. In some embodiments, a default state of the gaming machine may be that the secondary game buy-in option is disabled. The gaming machine may revert to the default state after the player confirms and/or cancels the selection of the secondary game buy-in option.

At 718, which may occur after the player rejects a secondary game buy-in option at 708 or after the secondary game buy-in option is disabled at 716, a wager by the player is collected. The wager may be a number of GCs. A number of game credits associated with the player may be debited to cover the wager.

In some embodiments, the gaming machine may employ multiple credit types. In that case, wager may be a number PGCs and/or a number of EECs and/or a combination of ECCs and PGCs. A number of credits associated with the player such as ECCs and/or PGCs may be debited to cover the wager.

At 720, an instance of a primary game title is provided.

At 722, a determination is made as to whether an outcome of the instance of the primary game triggers an instance of the secondary game. If the determination is affirmative, the process continues at 714. If the determination is negative, the process returns to 702.

Figure 8A:
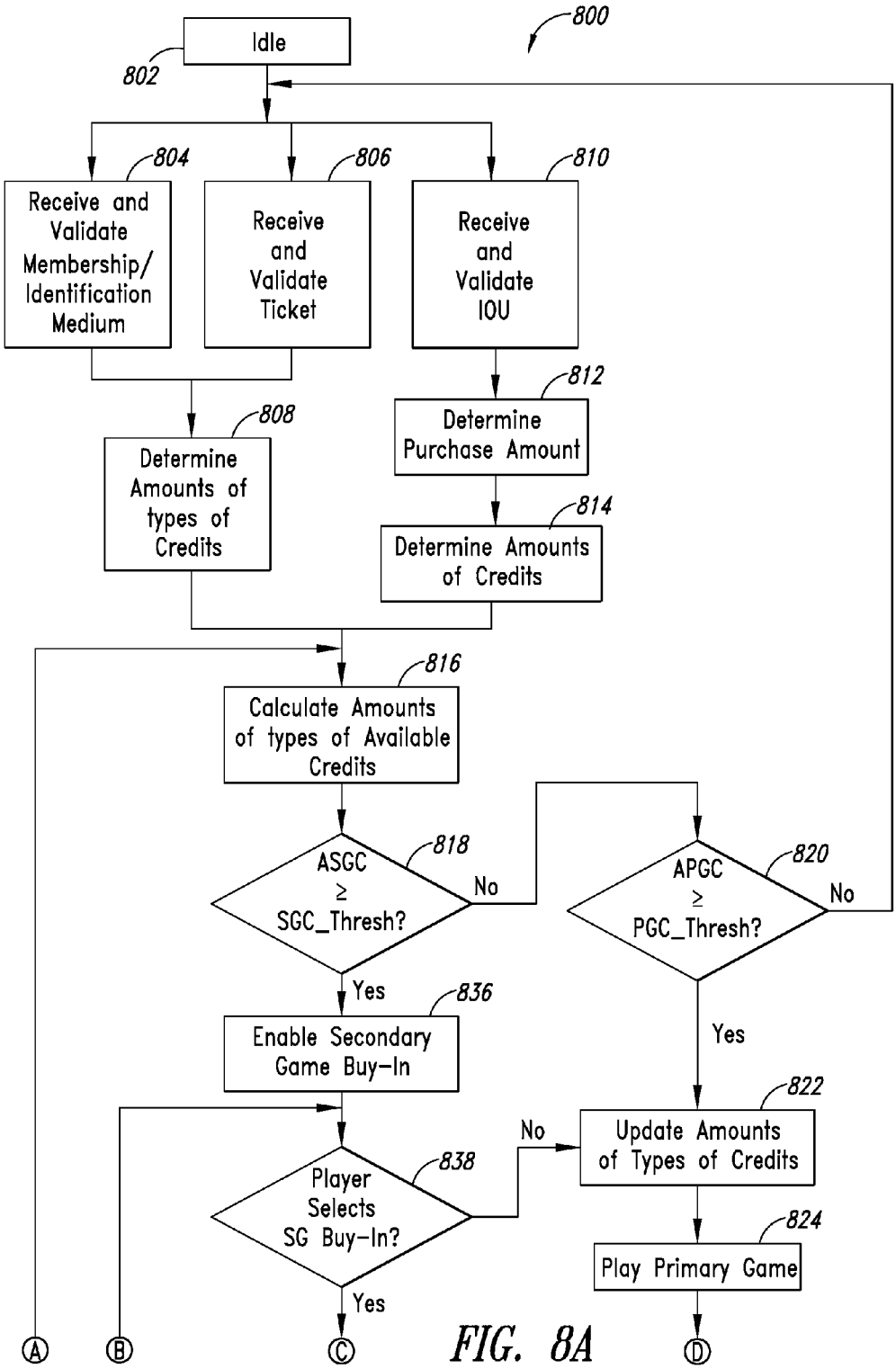
FIGS. 8A and 8B are a flow diagram of a method for enhancing gaming at a gaming machine configured to provide instances of gameplay of a primary game and selectively provide instances of gameplay of a secondary game according to one illustrated embodiment.
Figure 8B:
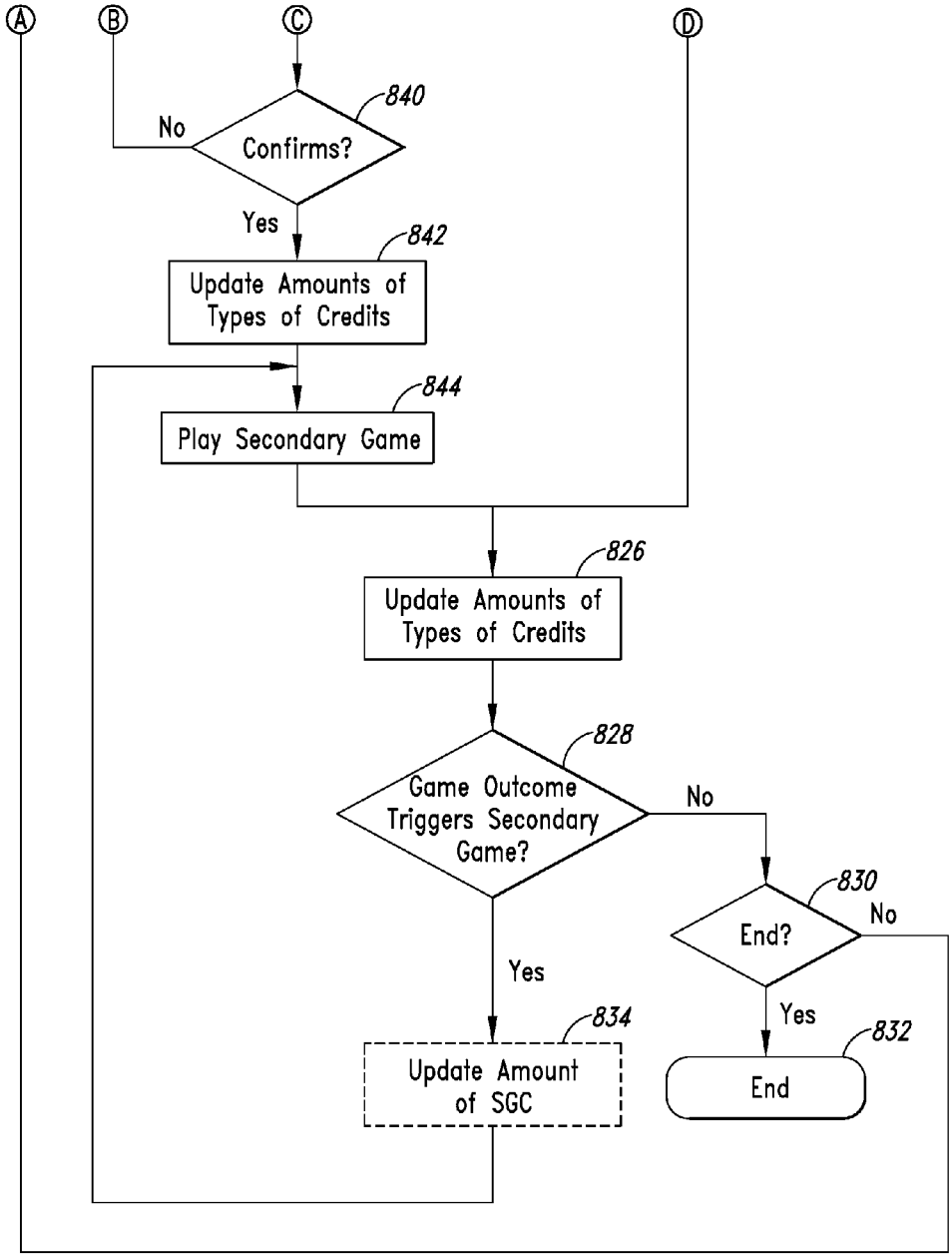

FIG. 8 shows a flow diagram 800 of a method for enhancing gaming at a gaming machine configured to provide instances of gameplay of a primary game and selectively provide instances of gameplay of a secondary game according to one illustrated embodiment. In the description of flow diagram 800, various types of credits, ECCs, PGCs, and SGCs, are explicitly mentioned, without limitation, for the sake of clarity. In some embodiments, one of more of the various types of credits may include fully redeemable credits and/or partially redeemable credits, e.g., fECCs, pECCs, fPGCs, pPGCs, fSGCs, and pSGCs. In some embodiments, the gaming machine may employ a single game credit (GC). In that case, some of the blocks described below may be optional.

At 802, a gaming machine is idle.

At 804, the gaming machine receives a member identification medium and validates the member identification medium. When the gaming machine receives a valid member identification medium, the gaming machine may read the member indicator indicative of an identifier for a specific member from the received member identification medium. The gaming machine may provide the system controller 116 with a unique identifier indicator that may be indicative of the member indicator. The system controller 116 may use the unique identifier indicator to determine a membership record 124 associated with the received member identification medium.

At 806, the gaming machine receives a ticket and validates the ticket. When the gaming machine receives a valid ticket, the gaming machine may have read the ticket identifier from the received member identification medium. The gaming machine may provide the system controller 116 with a unique identifier indicator that may be indicative of the ticket identifier. The system controller 116 may use the unique identifier indicator to determine a ticket record 124 associated with the received ticket.

At 808, amounts for various types of credits, e.g., ECCs, PGCs, and SGCs, may be determined. In some embodiments, the determination may be based at least on information received from the system controller 116. In some embodiments, the determination may be based at least on information read from one or both of a received membership identification medium and a ticket. In some embodiments, a respective membership identification medium may encode credit information indicative of amounts of various types of credits. In some embodiments, a respective ticket may encode credit information indicative of amounts of various types of credits.

In some embodiments, the gaming machine may employ a single game credit. In that case, the gaming machine determines an amount of GCs, which may be based at least on credit information encoded by a respective membership and/or credit information encoded by a respective ticket.

At 810, the gaming machine receives an item of value and validates the item of value. Among other things, the item of value may be a unit of a currency and/or a financial medium associated with a financial account.

At 812, the gaming machine determines a purchase amount. The purchase amount may be based at least on a determination of a denomination of a received unit of a currency. The purchase amount may be based at least on an indication of a monetary amount payable from a financial account associated with a received financial medium.

At 814, amounts of various types of credits, e.g., ECCs, PGCs, and SGCs, may be determined based at least on the determined purchase amount. In some embodiments, the player may select the various types of credits that the player desires to purchase. In some embodiments, the purchase amount may be applied to purchasing one type of credit such as, but not limited to, ECCs. However, in some embodiments, one type of credit, e.g., ECC, may be convertible into another credit type, e.g., SGC.

If the gaming machine employs a single credit type, a number of GCs is determined based at least on the purchase amount.

At 816, available amounts of types of credits may be calculated based at least on the determined numbers of types of credits. For example, a player's amount of available secondary game credits (ASGCs) may be based at least on a number of SGCs currently associated with the player and/or a number of SGCs awarded to the player and/or a number of SGCs purchased by the player. In addition, a player's amount of ASGCs may depend at least on a number of PGCs and/or ECCs. In some embodiments, a player's amount of ASGCs may depend at least on credits and/or a value carried by and/or associated with a membership identification medium. In some embodiments, a player's amount of ASGCs may depend at least on credits and/or a value carried by and/or associated with a ticket. In some embodiments, a player's amount of ASGCs may depend at least on a value carried by and/or associated with an item of value.

As another nonlimiting example, in some embodiments a player's amount of available primary game credits (APGCs) may be based at least on a number of PGCs currently associated with the player and/or a number of PGCs awarded to the player and/or a number of PGCs purchased by the player. In addition, a player's amount of APGCs may depend at least on a number of SGCs and/or ECCs. In some embodiments, a player's amount of APGCs may depend at least on credits and/or a value carried by and/or associated with a membership identification medium. In some embodiments, a player's amount of APGCs may depend at least on credits and/or a value carried by and/or associated with a ticket. In some embodiments, a player's amount of APGCs may depend at least on a value carried by and/or associated with an item of value.

Similarly, in some embodiments, a player's amount of available entertainment center credits (AECCs) may be based at least on a number of ECCs currently associated with the player and/or a number of ECCs awarded to the player and/or a number of PGCs purchased by the player. In addition, a player's amount of AECCs may depend at least on a number of PGCs and/or SGCs. In some embodiments, a player's amount of AECCs may depend at least on credits and/or a value carried by and/or associated with a membership identification medium. In some embodiments, a player's amount of AECCs may depend at least on credits and/or a value carried by and/or associated with a ticket. In some embodiments, a player's amount of AECCs may depend at least on a value carried by and/or associated with an item of value.

Similarly, in some embodiments if the gaming machine employs a single type of credit (GC), a player's amount of available game credits (AGCs) may be based at least on the amount of GCs determined at 808 or based at least on the amount of GCs determined at 814 and/or an aggregate of the amount of GCs determined at 808 and at 814.

At 818, a determination is made as to whether the player has a sufficient number of ASGCs, e.g., whether the player's number of ASGCs exceeds a secondary game credit threshold (SGC_Thresh).). If the determination is negative, the method continues at 820. On the other hand, if the determination is affirmative, the method continues at 836.

Similarly if the gaming machine employs a single type of credit (GC), the determination may be whether the player has a sufficient number of AGCs, e.g., whether the player's number of AGCs exceeds the secondary game credit threshold (SGC_Thresh At 820, a determination is made as to whether the player has a sufficient number of APGCs, e.g., whether the player's number of APGCs exceeds a primary game credit threshold (PGC_Thresh). If the determination is negative, the method continues at 802. On the other hand, if the determination is affirmative, the method continues at 822.

Similarly if the gaming machine employs a single type of credit (GC), the determination may be whether the player has a sufficient number of AGCs, e.g., whether the player's number of AGCs exceeds the primary game credit threshold (SGC_Thresh).

At 822, amounts of credits for the player are updated. For example, at least a portion of the value of the PGC_Thresh may be subtracted from a number of PGCs of the player. If the player's number of PGCs is less than the value of the PGC_Thresh, then at least a portion of the PGC_Thresh may be subtracted from a number of ECCs and/or SGCs of the player. In some embodiments, a player may wager an amount of credits greater than the PGC_Thresh. In that case, the amounts of credits for the player are updated based on the wagered amount of credits.

Similarly, if the gaming machine employs a single credit, the number of GCs corresponding to the wager of the player, which may be greater than or equal to PGC_Thresh, is debited from the player's number of GCs.

At 824, an instance of the primary game is provided to the player.

At 826, amounts of types of credits are updated based at least on an outcome of the game most recently played. As a consequence of the played game, the player may receive and/or be awarded with a respective number of ECCs, PGCs, and/or SGCs. Based at least in part on the outcome of the most recently played game, the player's number of ECC's and/or PGCs and/or SGCs may be updated.

Similarly, if the gaming machine employs a single credit, player's number of GCs may be updated based at least in part on the outcome of the most recently played primary game.

At 828, a determination is made as to whether the outcome of the most recently played game triggers an opportunity for the player to play an instance of the secondary game. If the determination is negative, the method continues at 830, otherwise the method continues at 834.

At 830, a determination is made as to whether to end the player's session. The determination may be based at least in part on input provided by the player and/or a lack of input from the player. If the determination is affirmative, the method ends at 832. On the other hand, if the determination is negative, the method continues at 816.

At 834, a player's number of SGCs may be updated based at least on the outcome of the most recently played instance of the secondary game. The update may be based at least in part on the secondary game credit threshold. In some embodiments, the outcome of the most recently played game may trigger a "free" instance of the secondary game, and in that case, block 834 may not be necessary. In some embodiments, the outcome of the most recently played game may trigger a "discount" instance of the secondary game, and in that case, the update may be based at least in part on the secondary game credit threshold and/or the discount.

Similarly, if the gaming machine employs a single type of credit (GC), a player's number of GSs may be updated based at least on the outcome of the most recently played instance of the secondary game.

Referring back to decision block 818, when the decision is affirmative, the method continues at 836. At 836, secondary game buy-in option is enabled. The player may be provided with notice of an option to purchase an instance of the secondary game. Among others, the notice of the option may be provided by visual indicators shown on a display of the gaming machine and/or audibly.

At 838, a determination is made as to whether the player has accepted the second game buy-in option based at least on player input. If the determination is negative, the method continues at 822. Otherwise, the method may continue at decision block 840.

At 840, which may be optional in some embodiments, the player provides input that confirms the player has accepted the secondary game buy-in option. If the player changes their mind, or accidentally/inadvertently accepted the second game buy-in option and the player provides an input indicative of a failure to confirm the acceptance of the second game buy-in option, the method returns to 838. Otherwise, if the player confirms the acceptance of the second game buy-in option, the method continues at 842.

At 842, amounts of credits for the player are updated. For example, the at least a portion of the value of the SGC_Thresh may be subtracted from a number of SGCs of the player. If the player's number of SGCs is less than the value of the SGC_Thresh, then at least a portion of the SGC_Thresh may be subtracted from a number of ECCs and/or PGCs of the player.

Similarly, if the gaming machine employs a single credit type, at least a portion of the value of the SGC_Thresh may be subtracted from a number of GCs of the player.

At 844, an instance of the secondary game is provided to the player. After the secondary game has been played, the method continues at 826.

As an example, a slot-based game is configured to have a payback percentage of 90%. The secondary bonus game associated with the base game pays from 50 credits up to 500 credits with an average pay of 126 credits. In one embodiment, a player may apply 140 credits for the opportunity to play the secondary game without being required to play the primary game. The result will be the player experiencing the secondary bonus game for 140 credits with a chance of winning up to 500 credits. It is also possible that the player will only win the minimum 50 credits, but on average the player will win 126 credits, maintaining the 90% payback percentage of the game. The buy-in amount required from the player is calculated by dividing the average pay by the game's overall payback percentage, or, in this example, 126/0.9=140. This allows the gaming machine to maintain its theoretical payback percentage. The formula for one embodiment is:

$$W=A/p$$

where:

W=the wager amount required from the casino patron,

A=the average win amount of the secondary bonus game, and p=the overall payback percentage of the game.

Alternative embodiments may use a formula based on hit frequency, games played, player tracking status, player tracking points, or other statistics or combinations thereof. As an example, an alternate embodiment may calculate the secondary game buy-in as the frequency of the secondary game multiplied by a minimum wager amount, multiplied by the payback percentage. For example, a slot-based game is configured for a 90% payback, where the secondary game is initiated every 170 games on average, with a minimum wager of 1 credit. In this example, the player buy-in to the secondary game is 153 credits, or 170×1×0.9=153. The formula for this alternative embodiment is:

$$W=F\times B\times p$$

where:

W=the wager amount required from the casino patron,

F=the frequency of initiating the secondary bonus,

B=the minimum bet, and p=the overall payback percentage of the game.

Another alternate embodiment may allow the player to use player tracking points for the secondary game buy-in in conjunction with one of the embodiments above.

In yet another embodiment, the secondary game buy-in option may be configured to allow the player to buy-in to the secondary game for an amount that would be more than or less than the game's overall payback percentage.

Group Play:

In one embodiment, a player may buy-in to a group play secondary game. Once the group play has been initiated and enough credits are available on the credit meter to cover the buy-in amount, the player may be allowed to join the group play in the same method as one of the previously detailed embodiments.

Figure 9:
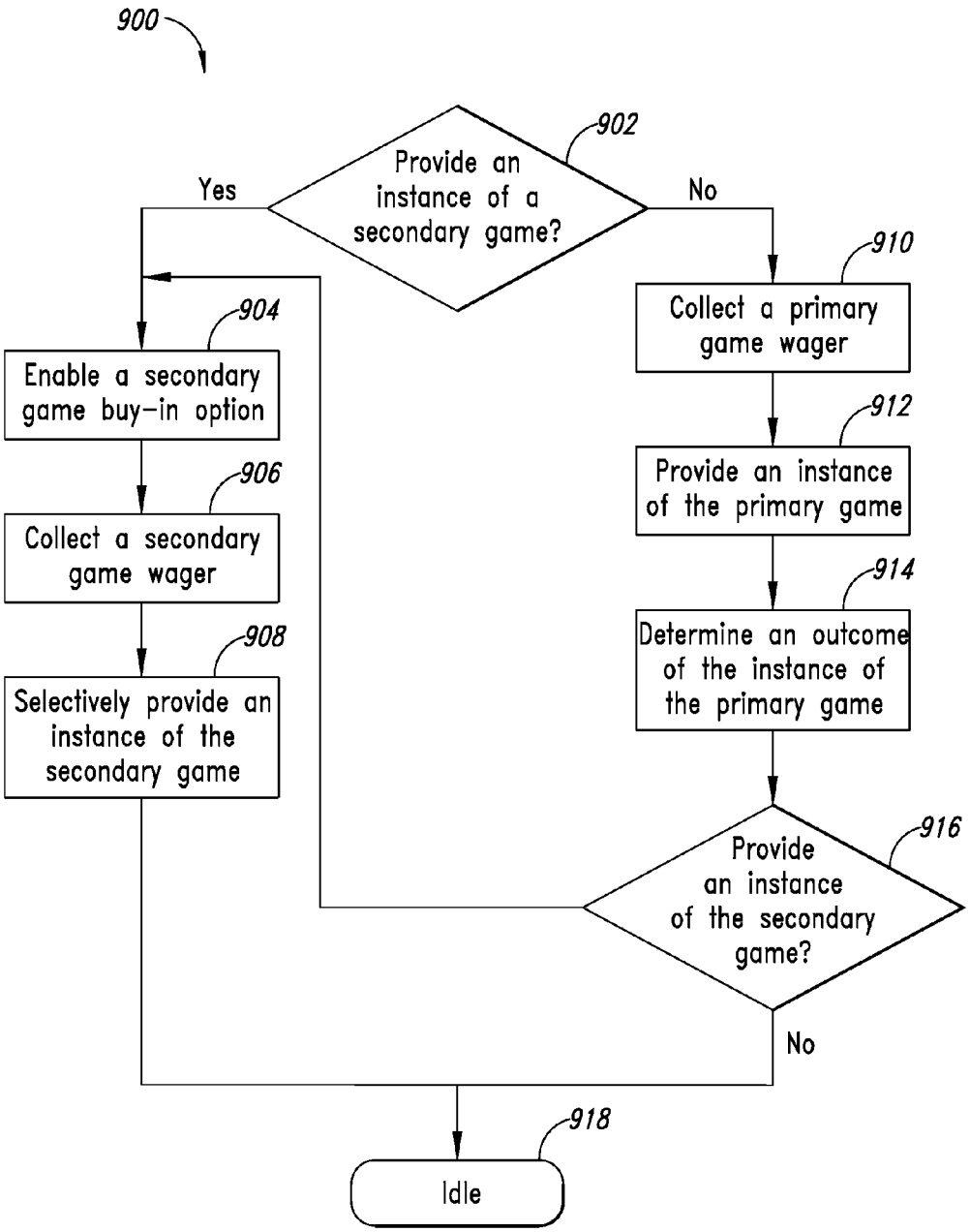
FIG. 9 is flow diagram of a method for enhancing gaming at a gaming machine configured to provide instances of gameplay of a primary game and selectively provide instances of gameplay of a secondary game according to one illustrated embodiment.

FIG. 9 shows a flow diagram 900 of a method for enhancing gaming at a gaming machine configured to provide instances of gameplay of a primary game and selectively provide instances of gameplay of a secondary game according to one illustrated embodiment. In the description of flow diagram 900, a single type of credit, game credit (GC) is explicitly mentioned, for the sake of clarity. However, in other embodiments, various types of other credits such as ECCs, PGCs, and SGCs, without limitation may be used. In some embodiments, one of more of the various types of credits may include fully redeemable credits and/or partially redeemable credits, e.g., fGCs, pGCs, fECCs, pECCs, fPGCs, pPGCs, fSGCs, and pSGCs.

At 902, a determination as to whether to provide an instance of a secondary game is made. The determination may be based at least in part on a current amount of available game credits (AGCs). If the determination is affirmative, the method continues at 904. Otherwise, the method continues at 910.

In some embodiments if the gaming machine employs tiered credits such as primary game credits, secondary game credits, and/or entertainment center credits, the determination may be based at least in part on a current amount of ASGCs. The number of ASGCs may be less than an actual number of secondary game credits (SGCs) for a player of the gaming machine. The amount of ASGCs may be based at least in part on the player's actual amount of ECCs and/or PGCs.

At 904, a secondary game buy-in option is enabled.

At 906, a secondary game wager is collected. The secondary game wager may be some or all of an amount of GCs. In some embodiments, the secondary game wager may correspond to a secondary game credit threshold, e.g., a minimum number of game credits needed to access an instance of the secondary game via the secondary game buy-in option.

In some embodiments if the gaming machine employs tiered credits such as primary game credits, secondary game credits, and/or entertainment center credits, the secondary game wager may be some or all of an amount of SGCs and/or an amount of PGCs and/or an amount of ECCs. In some embodiments, the secondary game wager may correspond to a secondary game credit threshold, e.g., a minimum number of secondary game credits needed to access an instance of the secondary game via the secondary game buy-in option.

At 908, an instance of the secondary game is selectively provided. In some embodiments, the instance of the secondary game is only provided if player input is indicative of acceptance of the secondary game buy-in option.

Referring back to 902, if the determination was negative, the method continues at 910, where a primary game wager is collected.

The primary game wager may be some or all of an amount of a player's GCs. In some embodiments, the primary game wager may correspond to a primary game credit threshold, e.g., a minimum number of game credits needed to access an instance of the primary game.

In some embodiments if the gaming machine employs tiered credits such as primary game credits, secondary game credits, and/or entertainment center credits, the primary game wager may be some or all of an amount of PGCs and/or an amount of SGCs and/or an amount of ECCs.

At 912, an instance of the primary game is provided.

At 914, an outcome of the instance of the primary game is determined. The determination of the outcome may include determining whether the outcome is a trigger for an instance of the secondary game. The determination of the outcome may include determining a number of GCs to be awarded to the player.

In some embodiments if the gaming machine employs tiered credits such as primary game credits, secondary game credits, and/or entertainment center credits, the determination may include determining a number of various credit types (ECCs, PGCs, SGCs) that may have been awarded to the player and/or determining whether the outcome triggers an instance of the secondary game, among other things.

At 916, a determination as to whether to provide an instance of the secondary game is made. The determination may be based at least in part on the determined outcome of the primary game. If the determination is to provide an instance of the secondary game, the method returns to 904. Otherwise, the method continues at 918, where the gaming machine is idle.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to ticket payment systems, not necessarily the exemplary game-entertainment system generally described above.

For instance, the foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

In addition, in one embodiment, the IOV subsystem may be communicatively coupled to a remote server/computer system, and the remote server/computer system may generate a pseudo ticket code when an item of value is not a ticket. The remote server/computer system may provide the pseudo ticket code to the IOV subsystem which may then provide the pseudo ticket code to the game session subsystem.

In addition, those skilled in the art will appreciate that the mechanisms taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

The various embodiments described above can be combined to provide further embodiments. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A computer-implemented method for enhancing gaming at a gaming machine configured to provide instances of gameplay of a primary game and selectively provide instances of gameplay of a secondary game, comprising:

for each of a plurality of times, determining whether to provide a secondary game buy-in option based on a comparison of a current number of available credits to a secondary game threshold, by at least one processor;

based on the comparison of the current number of available credits to the secondary game threshold, providing the secondary game buy-in option for a first respective instance of the secondary game;

selectively providing, by the at least one processor, the first respective instance of the secondary game based at least on player-input indicative of acceptance of the secondary game buy-in option;

debiting, by the at least one processor, a respective first number of credits from the current number of available credits based at least on the player-input indicative of acceptance of the secondary game buy-in option, wherein the secondary game threshold is not the same as the respective first number of credits;

selectively providing, by the at least one processor, a respective instance of the primary game based at least on the current number of available credits;

debiting, by the at least one processor, a respective second number of credits from the current number of available credits based at least on the selectively providing the respective instance of the primary game;

for each of a number of times that the secondary game buy-in option is not provided based on the comparison of the current number of available credits to the second game threshold, determining whether to provide the secondary game buy-in option responsive to at least one outcome of the primary game, by the at least one processor; and from time-to-time, providing, by the at least one processor, the secondary game buy-in option to a second respective instance of the secondary game based at least on at least one respective outcome of at least one instance of the primary game.

2. The method of claim 1, further comprising:

receiving an item-of-value;

determining an amount of monetary value based at least on the received item of value;

determining the current number of available credits based at least on the determined amount of monetary value.

3. The method of claim 1 wherein providing the secondary game buy-in option to a second respective instance of the secondary game based at least on respective outcomes of at least one instance of the primary game includes:

accruing a number of credits from respective outcomes of at least two instances of the primary game;

determining the current number of available credits based at least on the number of accrued credits; and triggering the secondary game buy-in option to the second respective instance of the secondary game based at least on the current number of available credits.

4. The method of claim 1, further comprising:

disabling the secondary game buy-in option to a third respective instance of the secondary game.

5. The method of claim 1, further comprising:

receiving a ticket having a number of credits associated therewith;

reading information from the ticket; and determining the current number of available credits based at least on the information read from the ticket.

6. A gaming system to selectively provide an instance of a primary game or a secondary game, comprising:

a player interface configured to receive input from a player;

a processor in communication with the player interface that executes instructions; and a memory in communication with the processor and having instructions stored therein that cause the processor to:

for each of a plurality of times, determine whether to provide a secondary game buy-in option based on a comparison of a current number of available credits to a secondary game threshold;

based on the comparison of the current number of available credits to the secondary game threshold, provide the secondary game buy-in option for a first respective instance of the secondary game;

selectively provide the first respective instance of the secondary game based at least on player-input indicative of acceptance of the secondary game buy-in option;

debit a respective first number of credits from the current number of available credits based at least on the player-input indicative of acceptance of the secondary game buy-in option, wherein the secondary game threshold is not the same as the respective first number of credits;

selectively provide a respective instance of the primary game based at least on the current number of available credits;

debit a respective second number of credits from the current number of available credits based at least on the provisioning a player with the respective instance of the primary game; and for each of a number of times that the secondary game buy-in option is not provided based on the comparison of the current number of available credits to the second game threshold, determine whether to provide the secondary game buy-in option responsive to at least one outcome of the primary game;

from time-to-time, provide the secondary game buy-in option to a second respective instance of the secondary game based at least on at least one respective outcome of at least one instance of the primary game.

7. The gaming system of claim 6 wherein the instruction that causes the processor to provide the secondary game buy-in option to a second respective instance of the secondary game based at least on respective outcomes of at least one instance of the primary game includes further instructions that cause the processor to:

accrue a number of credits from respective outcomes of at least two instances of the primary game;

determine the current number of available credits based at least on the number of accrued credits; and trigger the secondary game buy-in option to the second respective instance of the secondary game based at least on the current number of available credits.

8. The gaming system of claim 6 wherein the memory stores further instructions that cause the processor to:

disable the secondary game buy-in option to a third respective instance of the secondary game.

9. A computer-implemented method for enhancing gaming at a gaming machine configured to provide instances of gameplay of a primary game and selectively provide instances of gameplay of a secondary game, comprising:

determining, by at least one processor, whether to provide a respective instance of a secondary game, the providing being able to be triggered based at least on a respective current amount of available secondary game credits, by comparing the current number of available secondary game credits to a secondary game threshold, the current number of available secondary game credits being distinct from a current number of available primary game credits;

if the determining whether to provide a respective instance of a secondary game results in a determination to provide the respective instance of the secondary game, then:

enabling, by the at least one processor, a secondary game buy-in option, collecting a respective first wager, wherein the secondary game threshold is not the same as the respective first wager, and selectively providing, by the at least one processor, a first instance of the secondary game; and if the determining whether to provide a respective instance of a secondary game results in a determination to not provide the respective instance of the secondary game, then:

collecting, by the at least one processor, a respective second wager, providing, by the at least one processor, a first instance of the primary game, determining, by the at least one processor, an outcome of the first instance of the primary game, and determining, by the at least one processor, whether to provide another respective instance of the secondary game based at least on the outcome of the first instance of the primary game.

10. The method of claim 9 further comprising:

receiving player input indicative of one of acceptance or rejection of the secondary game buy-in option in response to the determination to provide the respective instance of the secondary game, wherein the respective instance of the secondary game is provided only if the player input is indicative of acceptance of the secondary game buy-in option.

11. The method of claim 9, further comprising:

providing a respective instance of the secondary game in response to determining whether to provide a respective instance of the secondary game based at least on the outcome of the first instance of the primary game.

12. The method of claim 9, further comprising:

updating the respective current amount of available secondary game credits based at least on one of an outcome of the first instance of the primary game or an outcome of the first instance of the secondary game.

13. The method of claim 9, further comprising:

after selectively providing the first instance of the secondary game, determining whether to provide a second instance of the secondary game based at least on an outcome of the first instance of the secondary game.

14. The method of claim 9 wherein determining whether to provide a respective instance of the secondary game that is triggerable based at least on the respective current amount of available secondary game credits includes:

determining to provide the respective instance of the secondary game if, based on the comparison, the respective current amount of available secondary credits exceeds the secondary game threshold.

15. The method of claim 9, further comprising:

receiving an item-of-value;

determining a monetary amount based at least on the item-of-value; and determining a number of secondary game credits based at least on the monetary amount.

16. The method of claim 9, further comprising:

receiving a ticket having a number of secondary game credits associated therewith;

reading information from the ticket; and determining a number of secondary game credits based at least on the information read from the ticket.

17. The method of claim 9, further comprising:

determining a respective current amount of available primary game credits; and determining the respective current amount of available secondary game credits based at least on the respective current amount of available primary game credits.

* * * * *